US006259422B1

(12) United States Patent
Hamamoto

(10) Patent No.: US 6,259,422 B1
(45) **Date of Patent: *Jul. 10, 2001**

(54) METHOD FOR PRODUCING IMAGE-FORMING APPARATUS

(75) Inventor: Yasuhiro Hamamoto, Machida (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 46 days.

(21) Appl. No.: 09/128,543

(22) Filed: Aug. 4, 1998

(30) Foreign Application Priority Data

Aug. 6, 1997 (JP) ..... 9-212087

(51) Int. Cl.[7] ..... G09G 3/22; G09G 3/10
(52) U.S. Cl. ..... 345/74.1; 345/75.1; 315/169.3
(58) Field of Search ..... 345/74.1–75.1; 315/169.3; 445/53

(56) References Cited

U.S. PATENT DOCUMENTS

| | | | | |
|---|---|---|---|---|
| 5,066,883 | | 11/1991 | Yoshioka et al. | 313/309 |
| 5,532,544 | * | 7/1996 | Yoshioka et al. | 315/169.3 |
| 5,610,478 | | 3/1997 | Kato et al. | 315/169.1 |
| 5,622,634 | * | 4/1997 | Noma et al. | 315/169.3 |
| 5,659,329 | * | 8/1997 | Yamanobe et al. | 345/74 |
| 5,886,988 | * | 2/1999 | Oda | 315/169.3 |

FOREIGN PATENT DOCUMENTS

| | | |
|---|---|---|
| 0 714 114 | 5/1996 | (EP) . |
| 0 817 232 | 1/1998 | (EP) . |
| 1-031332 | 2/1989 | (JP) . |
| 1-283749 | 11/1989 | (JP) . |
| 2-257552 | 10/1990 | (JP) . |
| 2-299129 | 12/1990 | (JP) . |
| 7-235255 | 9/1995 | (JP) . |
| 8-264112 | 10/1996 | (JP) . |

OTHER PUBLICATIONS

Dyke and Dolan, "Field Emission" Adv. Electronics and Electron Physics, vol. VIII (1956) pp. 89–185.
Spindt et al., "Physical properties of thin–film field emission cathodes with molybdenum cones" J. Appl. Physics, vol. 47, No. 12 (1976) pp. 5248–5263.
Mead, "Operation of Tunnel–Emmission Devices" J. Appl. Physics, vol. 32, No. 4 (1961) pp. 646–652.
Elinson, et al., "The Emission of Hot Electrons and the Field Emission of Electrons from Tin Oxide" Radio Eng. and Electronic Physics (1965) pp. 1290–1296.
Dittmer, "Electrical Conduction and Electron Emission Of Discontinuous Thin Films" Thin Solid Films, vol. 9 (1972) pp. 317–328.
Hartwell and Fonstad, "Strong Electron Emission From Patterned Tin–Indium Oxide Thin Films" Int. Electron Devices Meeting Tech. Digest (1975) pp. 519–521.
Araki, et al., "Electroforming and Electron Emission of Carbon Thin Films" J. Vacuum Soc. Japan, vol. 26, No. 1 (1983) pp. 22–29.

* cited by examiner

*Primary Examiner*—Richard Hjerpe
*Assistant Examiner*—Duc Dinh
(74) *Attorney, Agent, or Firm*—Fitzpatrick, Cella, Harper & Scinto

(57) ABSTRACT

A method for producing an image-forming apparatus, the image-forming apparatus comprises a container, an electron-emitting device disposed in the container and has an electron-emitting section between a pair of electrodes, the electron-emitting device being adapted to emit electrons with application of a voltage between the pair of electrodes, and an image-forming member for forming an image by irradiation of the electrons emitted from the electron-emitting device, the production method having a step of irradiating the image-forming member with electrons emitted from the electron-emitting device, wherein the electrons to irradiate the image-forming member are electrons emitted by applying to the electron-emitting device the voltage of an opposite polarity to that of a voltage applied between the pair of electrodes of the electron-emitting device during driving for image formation of the image-forming apparatus.

15 Claims, 18 Drawing Sheets

METHOD FOR PRODUCING IMAGE-FORMING APPARATUS

BACKGROUND OF THE INVENTION

1. Field of the Invention

The present invention relates to a method for producing an image-forming apparatus using electron-emitting devices.

2. Related Background Art

The conventionally known electron-emitting devices are roughly classified under two types using thermionic emission devices and cold-cathode emission devices. The cold-cathode emission devices include field emission type (hereinafter referred to as "FE type") devices, metal/insulator/metal type (hereinafter referred to as "MIM type") devices, surface conduction electron-emitting devices, and so on. Examples of the FE type devices known include those disclosed in W. P. Dyke & W. W. Dolan, "Field emission," Advance in Electron Physics, 8, 89 (1956) or in C. A. Spindt, "PHYSICAL Properties of thin-film field emission cathodes with molybdenum cones," J. Appl. Phys., 47, 5248 (1976), and so on. Examples of the MIM type devices known include those disclosed in C. A. Mead, "Operation of Tunnel-Emission Devices," J. Appl. Phys., 32, 646 (1961), and so on. Examples of the surface conduction electron-emitting devices include those disclosed in M. I. Elinson, Radio Eng. Electron Phys., 10, 1290 (1965), and so on. The surface conduction electron-emitting devices utilize such a phenomenon that electron emission occurs when electric current is allowed to flow in parallel to a thin film of a small area formed on a substrate. Examples of the surface conduction electron-emitting devices reported heretofore include those using a thin film of $SnO_2$ by Elinson described above [M. I. Elinson, Radio Eng. Electron Phys., 10, 1290 (1965)], those using a thin film of Au [G. Dittmer: "Thin Solid Films," 9, 317 (1972)], those using a thin film of $In_2O_3/SnO_2$ [M. Hartwell and C. G. Fonstad: "IEEE Trans. ED conf.," 519, (1975)], those using a thin film of carbon [Hisashi Araki: Shinku (Vacuum), Vol. 26, No. 1, p22 (1983)], and so on.

The surface conduction electron-emitting devices described above are simple in structure and also easy to manufacture, and thus they have such an advantage that many devices can be arrayed across a large area. Research has been done on various applications taking advantage of this feature. For example, such applications include charged beam sources, display devices, and so on. An example of the application with an array of many surface conduction electron-emitting devices is an electron source in which surface conduction electron-emitting devices are arrayed in parallel, the both terminals of the individual devices are connected by respective wires (which are also called common wires) in each row, and many rows are arrayed, as described hereinafter. (Reference should be made, for example, to Japanese Laid-open Patent Application Nos. 64-031332, 1-283749, 2-257552, and so on.) Particularly, in the field of the image-forming apparatus such as the display devices, plane type display devices using the liquid crystal are recently becoming widespread, taking the place of CRT. However, they are not of the self-emission type, and thus they have the problem of having to include a back light, for example. Therefore, development of a self-emission type display device has long been desired heretofore. An example of the self-emission type display device is an image-forming apparatus which is a display device including a combination of an electron source having many surface conduction electron-emitting devices formed therein with a fluorescent member for emitting visible light by electrons emitted from the electron source. (Reference should be made, for example, to U.S. Pat. No. 5,066,883.)

In the plane type image-forming apparatus described above, an electron-source substrate with a plurality of electron-emitting devices arrayed thereon and an image-forming member with a fluorescent member etc. therein are disposed opposite to each other with a vacuum section in between. The above image-forming apparatus displays an image in such a manner that a scanning signal and/or a modulation signal is applied to the electron-emitting devices formed in the electron-source substrate to make each electron-emitting device or some electron-emitting devices emit electrons and that the electrons are accelerated by the anode voltage Va of several hundred V to several kV or more applied to the image-forming member to collide with the fluorescent member, thereby achieving emission of light therefrom.

The plane type image-forming apparatus described above, however, sometimes suffered a significant luminance drop or a dot or line defect in a display image in the early stage of operation. One of causes of these luminance drop and occurrence of defect is occurrence of vacuum discharge and characteristic degradation of electron-emitting device caused by vacuum deterioration (increase in pressure) in a vacuum panel. This vacuum deterioration in the vacuum panel takes places as follows; with actuation of the image-forming apparatus, electron beams start to irradiate the fluorescent member and metal back in the image-forming member, and the panel components including the wires, electrodes, electron-emitting devices, and so on in the electron-source substrate to cause desorption of adhesive gas molecules (or atoms) and the desorption of gas is also enhanced by impact of ions generated therewith, so that the gas thus generated degrades the vacuum (or increases the pressure) in the vacuum panel.

Conceivable countermeasures against the vacuum deterioration are "increasing evacuation performance" and "decreasing a degassing amount from each panel component."

For the former, it is conceivable to mount a getter pump (capture vacuum pump) of a sufficient capacity. In the conventional display devices kept in vacuum inside, such as the CRT, there are little spatial constraints on placement of the getter pump, so that the getter pump can be formed in a wide area. In the case of the CRT, a ratio of the surface area to the volume in the vacuum container was also small, and a sufficient vacuum was thus able to be maintained therein. In the case of the above plane type display devices, there are, however, many spatial constraints on placement of the getter pump, and normally, the getter pump is often formed in a limited area near the panel edge apart from the image display area. Since in the plane type vacuum container the distance to the image display area was very large with respect to the height in the container, there were issues that it was not easy to assure a sufficient exhaust conductance of the getter pump and that it was not easy to achieve sufficient evacuation of local degassing in the display device in particular.

For the latter, a conventional process employed was an evacuation baking process at high temperature to reduce the degassing amount from the panel components. However, normal baking at hundred and several ten ° C. is insufficient, and thus it cannot be said that this baking is a good solution to the aforementioned problem. Baking at higher temperatures will result in exclusion of use of members not resistant to the vacuum baking at the higher temperatures, i.e., members experiencing chemical reaction, alloy formation, cohesion of thin film, etc., and combinations thereof as the components used in the display device, so as to increase constraints on the structure of the display device, and it is thus not preferred.

SUMMARY OF THE INVENTION

An object of the present invention is to provide a method for producing an image-forming apparatus with high reliability by minimizing the degradation of electron-emitting devices during formation of image, particularly, by minimizing the degradation of electron-emitting devices due to the desorption of gas from the image-forming member during formation of image.

Another object of the present invention is to provide a method for producing an image-forming apparatus in which influence of the degradation of electron-emitting devices in the production process of the image-forming apparatus can be minimized during formation of image.

A production method of image-forming apparatus according to the present invention is a method for producing an image-forming apparatus, the image-forming apparatus comprising a container, an electron-emitting device disposed in the container and having an electron-emitting section between a pair of electrodes, the electron-emitting device being adapted to emit electrons with application of a voltage between the pair of electrodes, and an image-forming member for forming an image by irradiation of the electrons emitted from the electron-emitting device, the production method having a step of irradiating the image-forming member with electrons emitted from the electron-emitting device, wherein the electrons to irradiate the image-forming member are electrons emitted by applying to the electron-emitting device a voltage of an opposite polarity to that of a voltage applied between the pair of electrodes of the electron-emitting device during driving for image formation of the image-forming apparatus.

Another production method of image-forming apparatus according to the present invention is a method for producing an image-forming apparatus, the image-forming apparatus comprising a container, an electron-emitting device disposed in the container and having a plurality of electron-emitting sites between a pair of electrodes, the electron-emitting device being adapted to emit electrons from some of the plurality of electron-emitting sites with application of a voltage between the pair of electrodes, and an image-forming member for forming an image by irradiation of the electrons emitted from the electron-emitting device, the production method having a step of irradiating the image-forming member with electrons emitted from the electron-emitting device, wherein the electrons to irradiate the image-forming member are electrons emitted from different electron-emitting sites from those during driving for image formation of the image-forming apparatus.

DETAILED DESCRIPTION OF THE PREFERRED EMBODIMENTS

First, the aging step is a step of irradiating members in a panel container of the image-forming apparatus with electron beams accelerated, prior to driving for formation of image in the image-forming apparatus, thereby positively desorbing gas adhering to and remaining in the members in the panel container, from the members, and exhausting the gas.

The principal purpose of this aging step in the present invention is the desorption and exhaust of the gas adhering to and remaining in an image-forming member disposed in the panel container of the image-forming apparatus. The gas is desorbed from the image-forming member by mainly irradiating the image-forming member with the electron beams accelerated. Exhaust of this desorbed gas is achieved by exhausting the gas through an exhaust pipe connected to the panel container to the outside thereof, by making the gas adsorbed by a getter pump disposed in the panel container, or by a combination of the both. The irradiation of the image-forming member with the electron beams in the above aging step in the present invention is achieved by previously utilizing the electron-emitting devices used in the subsequent image-forming operation in the image-forming apparatus.

The present inventor accomplished the present invention, knowing that the electron-emitting devices used in the above aging step suffered degradation of electron emission characteristics, as compared with those before the aging step. Specifically, concerning driving of the electron-emitting devices, the polarity of the voltage applied to the electron-emitting devices was reversed during the above-stated aging step from that during the aforementioned image formation, whereby the electron emission characteristics nearly equivalent to those of the electron-emitting devices before the aging step were also obtained during the image formation after the aging step.

The preferred embodiments of the present invention will be described in detail.

First, an electron-emitting device applied to the present invention is a device having at least a pair of electrodes and adapted to emit an electron when a voltage is applied between the pair of electrodes, which is a device for emitting an electron even with inversion of the polarity of the voltage applied between the pair of electrodes, in other words, even with inversion of a direction of an electric field between the pair of electrodes.

A first preferred example of the electron-emitting device applied to the present invention is a surface conduction electron-emitting device.

<Surface Conduction Electron-emitting Device>

Figure 1A:
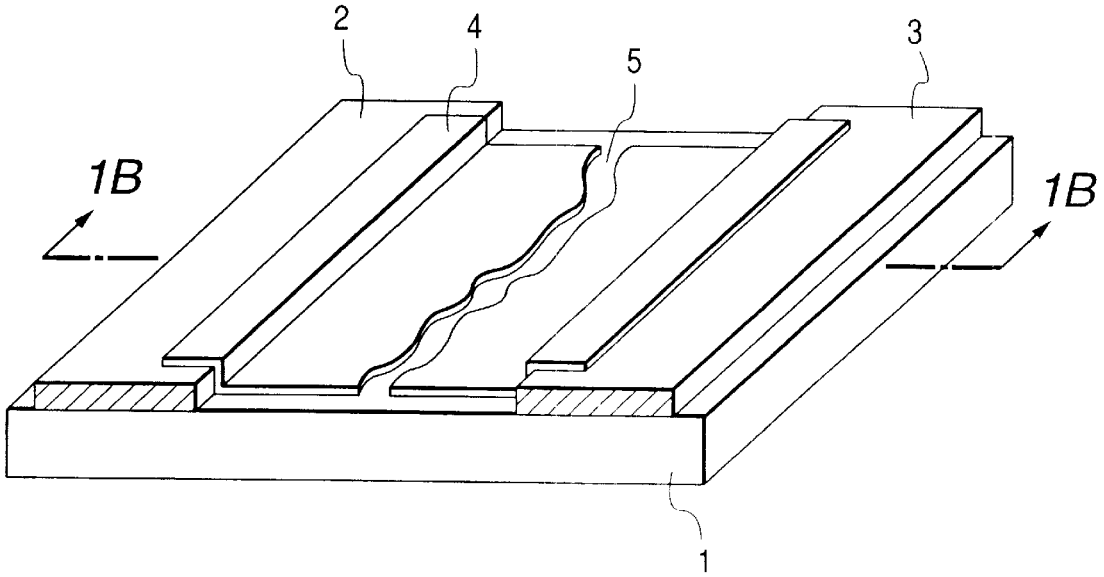
FIG. 1A is a perspective view to show the structure of a surface conduction electron-emitting device applied to the present invention and FIG. 1B is a sectional view thereof along 1B—1B.
Figure 1B:
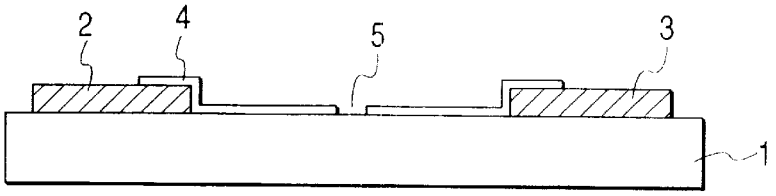

FIG. 1A is a schematic diagram to show the structure of a surface conduction electron-emitting device applied to the present invention and FIG. 1B is a sectional view along 1B—1B of FIG. 1A. In FIGS. 1A and 1B reference numeral 1 designates a substrate, 2 a first device electrode, 3 a second device electrode, 4 an electroconductive film, and 5 a clearance in the conductive film 4. When the voltage is placed between the pair of device electrodes 2, 3, the surface conduction electron-emitting device emits electrons from near the clearance 5.

The general structure, material, and production process of the surface conduction electron-emitting device are disclosed, for example, in Japanese Laid-open Patent Application Nos. 7-235255 and 8-264112 filed by the present applicant.

Figure 4:
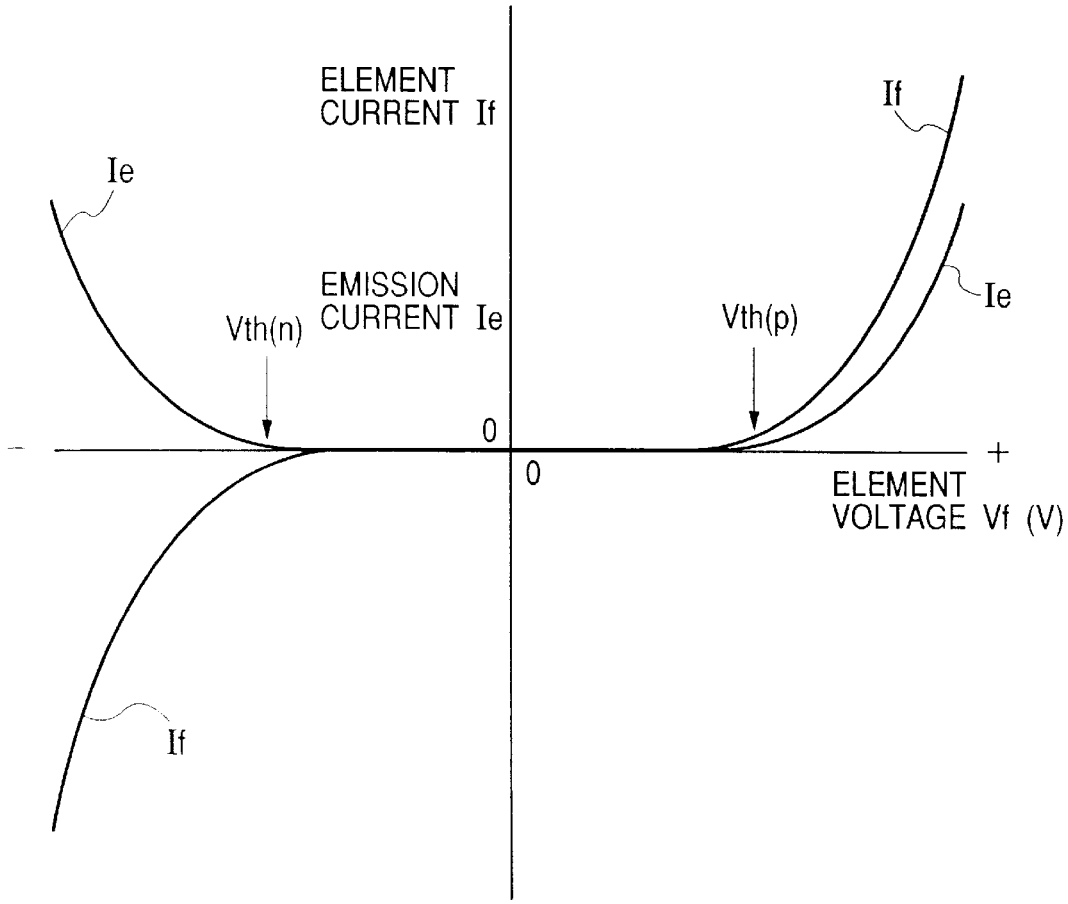
FIG. 4 is a drawing to show an example of the relation among emission current Ie, device current If, and device voltage Vf in the surface conduction electron-emitting device to which the present invention is applicable.

The surface conduction electron-emitting device has the device current characteristics and emission current characteristics as shown in FIG. 4. FIG. 4 is a diagram to show the relation of the device voltage Vf to the device current If and the emission current Ie, obtained in a state in which an anode electrode not illustrated is disposed above the surface conduction electron-emitting device and a positive voltage for drawing emission electrons out is applied to the anode electrode, wherein the device voltage Vf is the voltage applied to the first device electrode 2 with respect to the reference (0 V) of the second device electrode 3, the device current If is the current flowing between the two device electrodes, and the emission current Ie is the current of electrons emitted from the surface conduction electron-emitting device and captured by the anode electrode. The units in FIG. 4 are arbitrary units, because the emission current Ie is considerably smaller than the device current If. The abscissa and ordinate both are linear scales.

As apparent from FIG. 4, the emission current le quickly increases when the device voltage Vf over a certain threshold voltage Vth is applied to the surface conduction electron-emitting device; whereas little emission current le is detected with the device voltage below the threshold voltage Vth. Namely, the device is a nonlinear device having the definite threshold voltage Vth to the emission current le.

In addition, the surface conduction electron-emitting device has the positive threshold voltage Vth(p) and the negative threshold voltage Vth(n) as shown in FIG. 4, and the device emits electrons even with inversion of the polarity of the voltage applied between the device electrodes 2, 3, in other words, even with inversion of the direction of the electric field between the device electrodes 2, 3.

Figure 3:
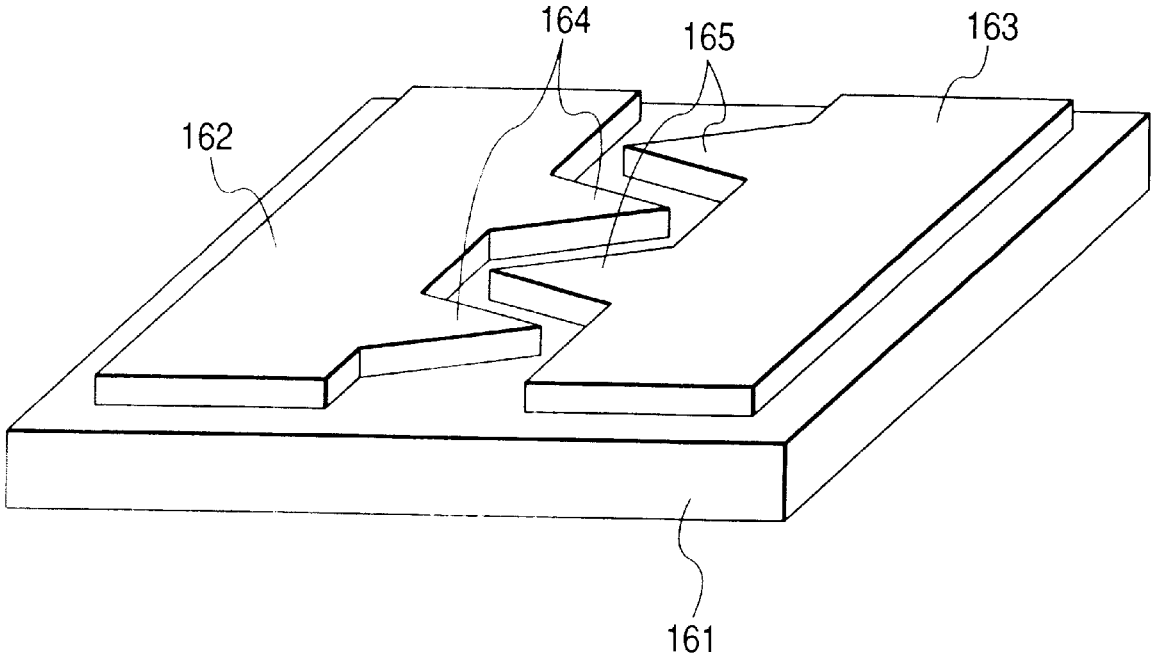
FIG. 3 is a perspective view to show the structure of a lateral electron emission type electron-emitting device applied to the present invention.

Another preferred example of the electron-emitting device applied to the present invention is the transverse field emission type electron-emitting device as shown in FIG. 3.

In FIG. 3, reference numeral 161 denotes an electrically insulative substrate, 162 a first electrode, and 163 a second electrode, and electron-emitting sections 164, 165 of projections are formed in mutually opposed side faces of the respective, first electrode 162 and second electrode 163. In the transverse field emission type electron-emitting device as shown in FIG. 3, there also exist the positive threshold voltage Vth(p) and the negative threshold voltage Vth(n) between the emission current le and the device voltage Vf as in the above device, and the device emits electrons even with inversion of the polarity of the voltage applied to the electrodes 162, 163, in other words, even with inversion of the direction of the electric field between the electrodes 162, 163.

It should be noted that the electron-emitting devices applied to the present invention are not limited to the above-stated surface conduction electron-emitting device and the above-stated transverse field emission type device but any device can be applied as long as it is an electron-emitting device having a pair of electrodes and adapted to emit electrons with application of the voltage between the pair of electrodes and emit electrons even with inversion of the direction of the electric field between the pair of electrodes, as described previously.

<Structure of Image-forming Apparatus>

The electron source applied to the present invention will be described below. The electron source applied to the present invention is, for example, an electron source in which a plurality of the above-stated surface conduction electron-emitting devices or the above-stated transverse field emission type electron-emitting devices are arrayed on a substrate.

The array of the electron-emitting devices can be selected from a variety of arrays.

For example, the array may be a ladder-like layout in which many electron-emitting devices placed in parallel are connected each at the both terminals, many rows of electron-emitting devices are arranged in a direction (called a row direction), a control electrode (also called a grid) is placed in a direction (called a column direction) perpendicular to the wiring and above the electron-emitting devices, and electrons from the electron-emitting devices are controlled by the control electrode. Another array is one in which a plurality of electron-emitting devices are arrayed in a matrix in the X-direction and in the Y-direction, one electrodes of the electron-emitting devices in each row are connected to a common wire in the X-direction, and the other electrodes of electron-emitting devices in each column are connected to a common wire in the Y-direction. This array is a so-called simple (passive) matrix layout.

Figure 5:
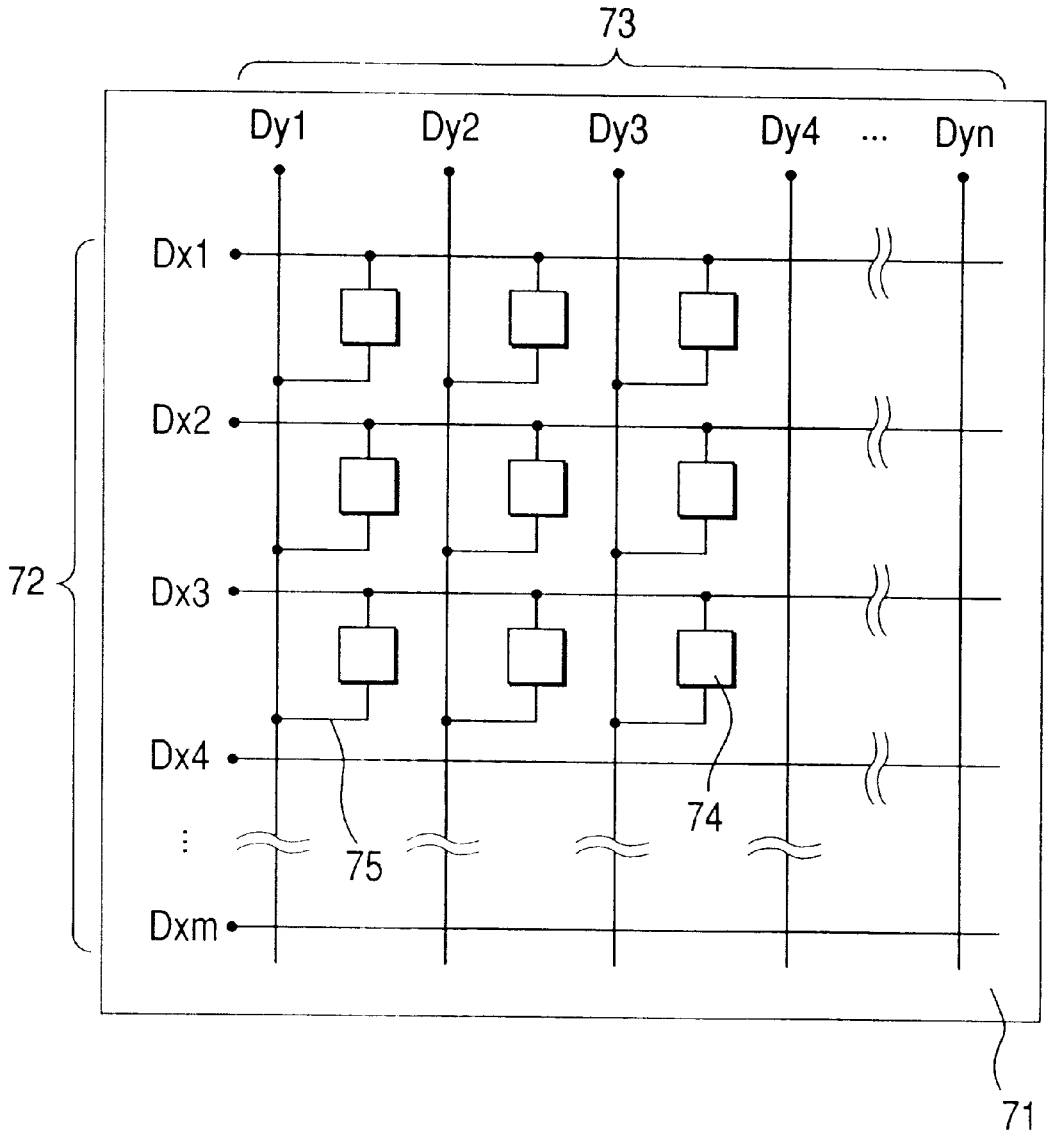
FIG. 5 is a schematic diagram to show an example of an electron source of a simple matrix (passive matrix) configuration to which the present invention is applicable.

As an example, the simple matrix layout will be described referring to FIG. 5. In FIG. 5, numeral 71 designates an electron-source substrate, 72 m X-directional wires Dx1 to Dxm, and 73 n Y-directional wires Dy1 to Dyn. Numeral 74 denotes the electron-emitting devices, for example, as stated above. An interlayer isolation layer not illustrated is interposed between these m X-directional wires 72 and n Y-directional wires 73, so as to electrically isolate them from each other (m, n both are positive integers).

The aforementioned pairs of electrodes (not illustrated) of the electron-emitting devices 74 are electrically connected to the m X-directional wires 72 and to the n Y-directional wires 73.

Connected to the X-directional wires 72 is a scanning signal applying means, not illustrated, for applying a scanning signal for selecting a row of electron-emitting devices 74 arranged in the X-direction. On the other hand, connected to the Y-directional wires 73 is a modulation signal generating means, not illustrated, for modulating each column of electron-emitting devices 74 arranged in the Y-direction, according to an input signal. The driving voltage applied to each electron-emitting device is supplied as a difference voltage between the scanning signal and the modulation signal applied to the device.

In the above configuration, each device can be selected and independently driven using the simple matrix wiring.

Figure 6:
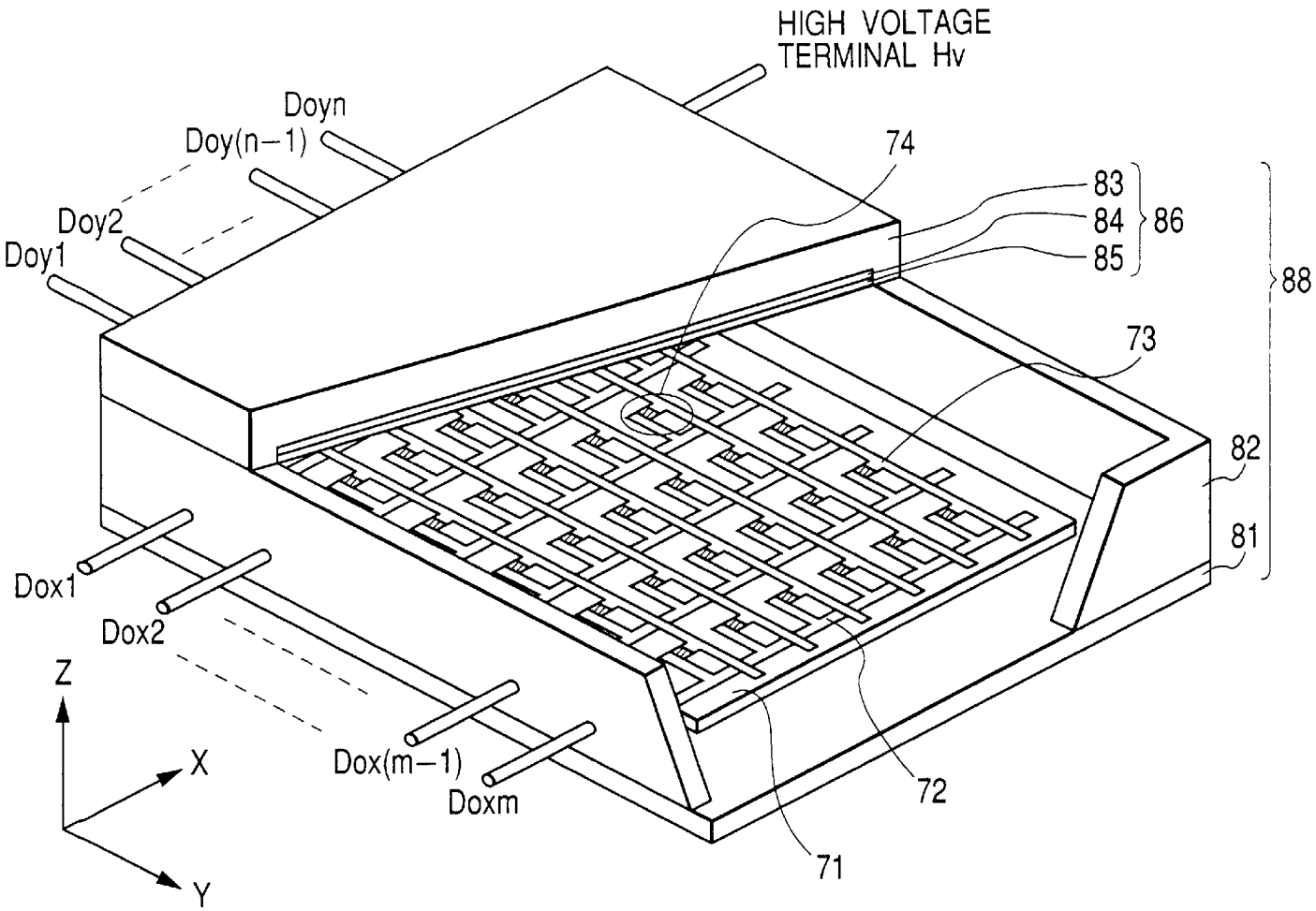
FIG. 6 is a schematic diagram to show an example of a display panel of an image-forming apparatus produced according to the present invention.
Figure 7A:
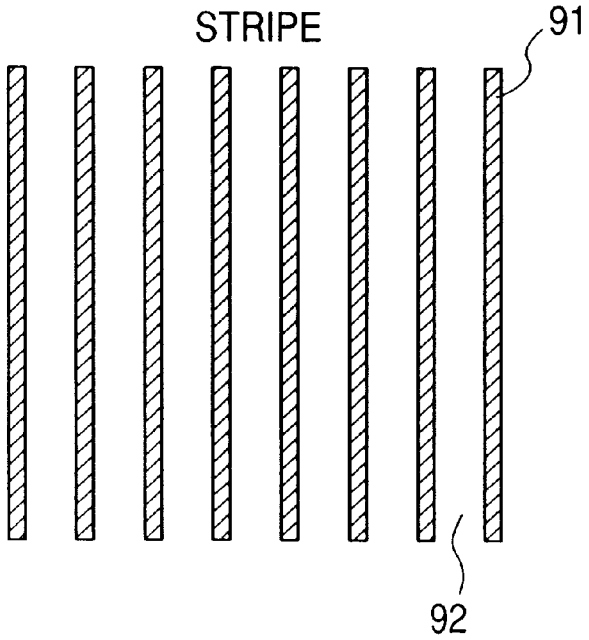
FIG. 7A is a schematic diagram to show an example of fluorescent film and FIG. 7B is a schematic diagram to show another example of fluorescent film.
Figure 7B:
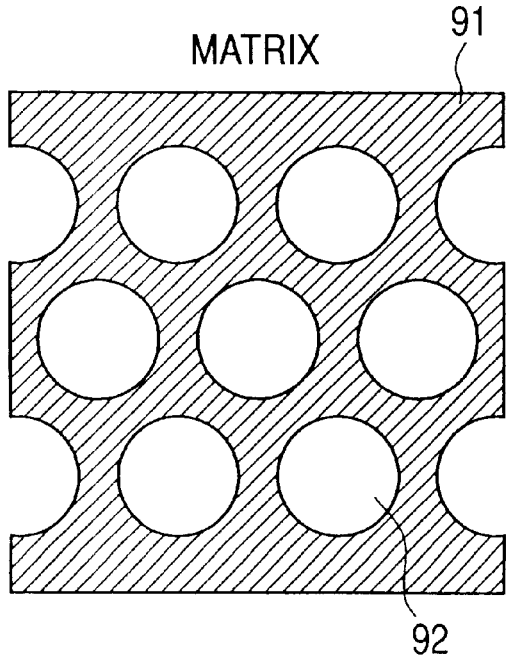
Figure 8:
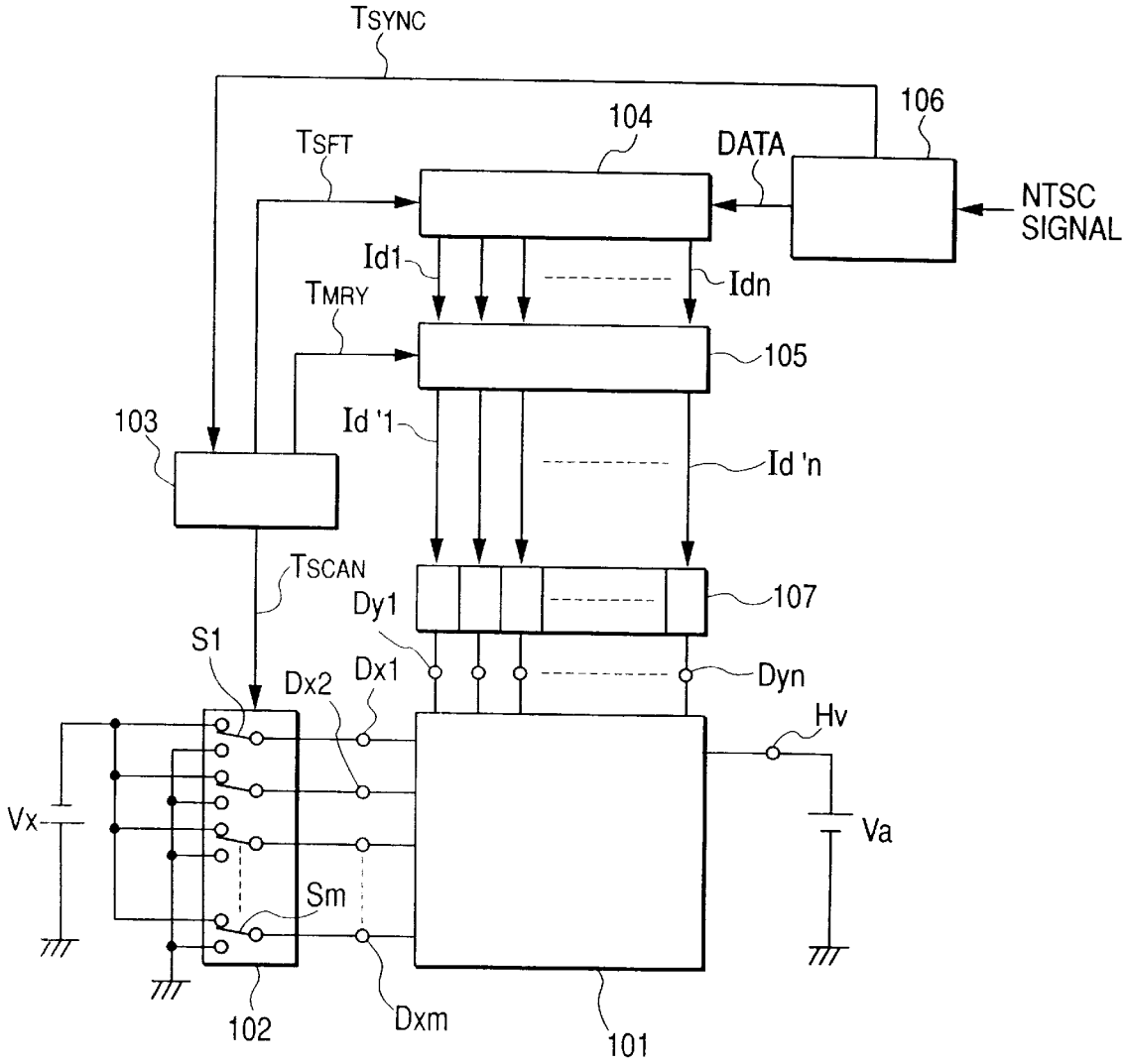
FIG. 8 is a block diagram to show an example of a driving circuit for performing the display according to TV signals of the NTSC method in the image-forming apparatus.

An image-forming apparatus constructed using the electron source of such a simple matrix layout will be described referring to FIG. 6, FIGS. 7A and 7B, and FIG. 8. FIG. 6 is a schematic diagram to show an example of the display panel in the image-forming apparatus and FIGS. 7A and 7B are schematic diagrams each to show a florescent film used in the image-forming apparatus of FIG. 6. FIG. 8 is a block diagram to show an example of a driving circuit for performing the display according to TV signals of the NTSC method.

In FIG. 6 reference numeral 71 designates an electron-source substrate in which a plurality of electron-emitting devices are placed, 81 a rear plate to which the electron-source substrate 71 is fixed, and 86 a face plate in which a fluorescent film 84, a metal back 85, etc. are formed on an internal surface of glass substrate 83. Numeral 82 denotes a support frame, and the support frame 82, rear plate 81, and face plate 86 compose an envelope 88 of the display panel.

Numeral 74 stands for the electron-emitting devices and 72, 73 respectively for the X-directional wires and Y-directional wires connected to the aforementioned pairs of electrodes of the electron-emitting devices.

The envelope 88 can also be constructed with sufficient strength against the atmospheric pressure by mounting an unrepresented support called a spacer between the face plate 86 and the rear plate 81.

FIGS. 7A and 7B are schematic diagrams each to show a fluorescent film. The fluorescent film 84 can be constructed of only a fluorescent member in the monochrome case. In the case of a color fluorescent film, the fluorescent film can be constructed of fluorescent members 92 and a black conductive material 91 called black stripes or a black matrix depending upon the array of the fluorescent members. Purposes of provision of the black stripes or the black matrix, in the case of the color display, are to make color mixture or the like unobstructive by blacking portions between the fluorescent members 92 of the three primary colors necessitated, and to suppress decrease in contrast due to reflection of ambient light on the fluorescent film 84. A material for the black stripes can be selected from materials including a principal component of graphite commonly widely used, or from electrically conductive materials with little transmission and reflection of light.

The metal back 85 is normally provided on the inner surface of the fluorescent film 84. Purposes of provision of the metal back are to enhance the luminance by specular reflection of light traveling to the inside out of the light emitted from the fluorescent members, toward the face plate 86, to use the metal back as an electrode for applying the electron beam acceleration voltage, to protect the fluorescent members from damage due to collision of negative ions generated in the envelope, and so on.

The face plate 86 may be provided with a transparent electrode (not illustrated) on the outer surface side of the fluorescent film 84 in order to enhance the electrically conductive property of the fluorescent film 84.

<Method for Producing Image-forming Apparatus>

The method for producing the above-stated image-forming apparatus in the present invention will be described below.

The following describes an example of the method for producing the image-forming apparatus using the surface conduction electron-emitting devices as the electron-emitting devices with reference to FIG. 6.

1) Formation of Electron-source Substrate

The m X-directional wires 72, n Y-directional wires 73, and pairs of device electrodes of the aforementioned surface conduction electron-emitting devices are formed on the insulative substrate 71 by vacuum evaporation and photolithography. The interlayer isolation layer is formed between the m X-directional wires 72 and the n Y-directional wires 73 to electrically isolate the wires from each other. The pair of device electrodes of each surface conduction electron-emitting device described above is formed near one of intersecting points between the X-directional wires 72 and the Y-directional wires 73 and each pair of device electrodes are electrically connected to the X-directional wire 72 and to the Y-directional wire 73. Then an electrically conductive film is formed between each pair of device electrodes. This electrically conductive film is formed, for example, by applying a solution of an organometallic compound by a spinner or by the ink jet method or the like and baking it.

2) Formation of Image-forming Member (Face Plate)

The slurry method or the like can be used as a method for applying the fluorescent members to the glass substrate 83. The metal back 85 is normally provided on the inner surface side of the fluorescent film 84 and the metal back can be produced by, after production of the fluorescent film, subjecting the surface on the inner surface side of the fluorescent film to a smoothing operation (normally called filming) and thereafter evaporating Al thereon in vacuum.

3) Sealing

Then the envelope as shown in FIG. 6 is made using the sealing technology. The rear plate 81 with the electron-source substrate 71, and the face plate 86 with the image-forming member comprised of the fluorescent film 84 and metal back 85 as described above are placed with the support frame 82 in between, a frit glass is applied to joint portions between the face plate 86, the support frame 82, and the rear plate 81, and sealing is achieved by baking it in the atmosphere or in a nitrogen ambience. On the occasion of the sealing, adequate positioning alignment is carried out in order to align the electron-emitting devices with the respective color fluorescent members in the color case.

Figure 9:
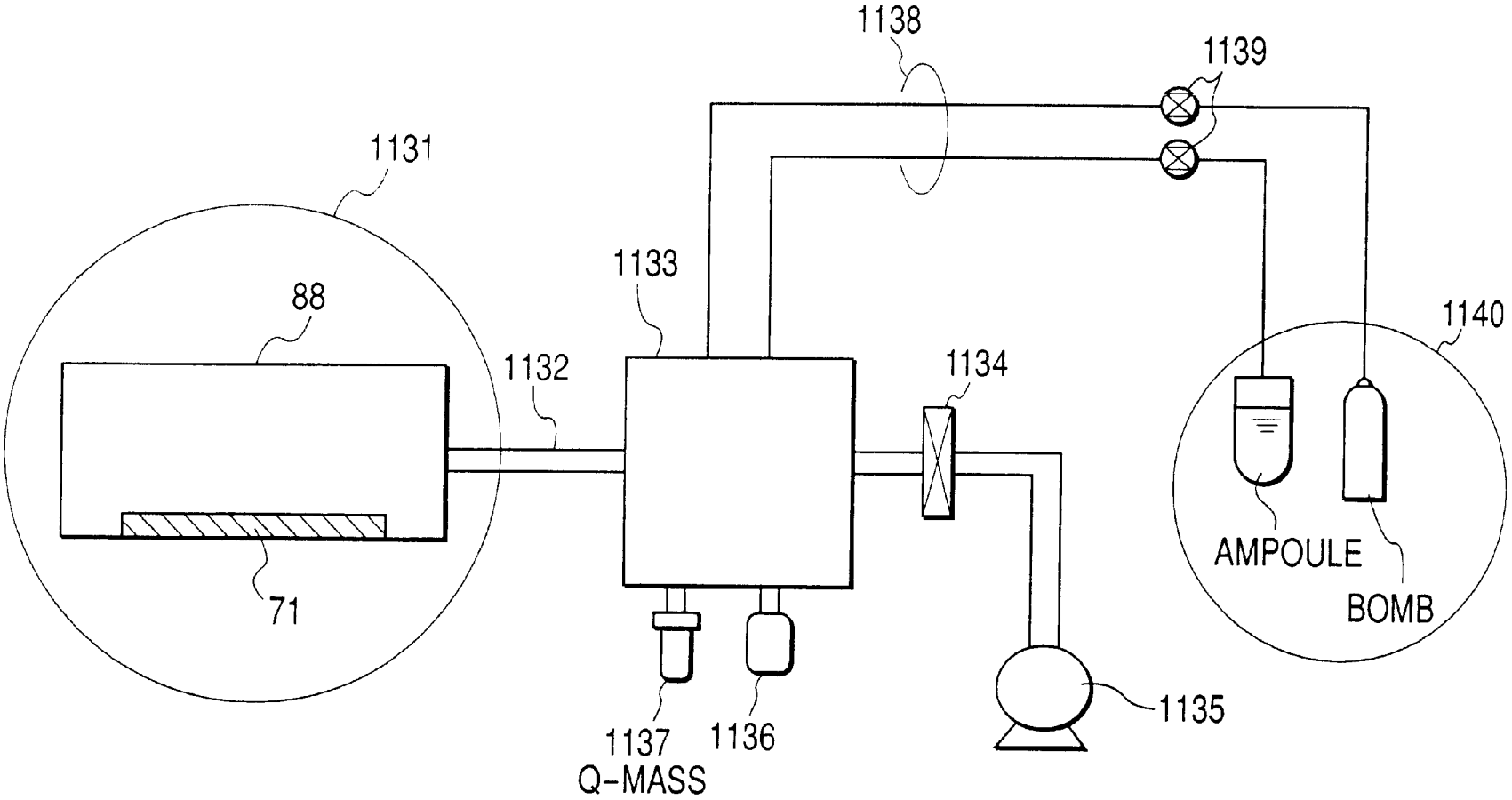
FIG. 9 is a drawing to show a vacuum system according to the present invention.

FIG. 9 is a schematic diagram to show the scheme of a system used in a subsequent step. The image-forming apparatus 1131 is connected through exhaust pipe 1132 to vacuum chamber 1133 and further connected through gate valve 1134 to evacuation unit 1135. A pressure gage 1136 and a quadrupole mass spectrometer 1137 or the like are attached to the vacuum chamber 1133 in order to measure the internal pressure and partial pressures of respective components in the atmosphere. Since it is difficult to directly measure the pressure inside the envelope 88 of the image-forming apparatus 1131, the operation conditions are controlled by measuring the pressure inside the vacuum chamber 1133.

A gas inlet line 1138 is further connected to the vacuum chamber 1133 in order to introduce a necessary gas into the vacuum chamber to control the ambience. An introduced substance source 1140 is connected to the other end of the gas inlet line 1138, and an introduced substance is stored in an ampoule or in a bomb therein. An introduction control unit 1139 for controlling a rate of introduction of the introduced substance is provided midway of the gas inlet line. The introducing amount control means can be selected specifically from a valve permitting control of leak rate, such as a slow leak valve, or a mass flow controller, depending upon a kind of the introduced substance.

4) Exhaust

Gas inside the envelope 88 thus completed is exhausted by the vacuum pump through the exhaust pipe 1132 connected to the fabrication apparatus of FIG. 9 described above.

5) Forming

Figure 10:
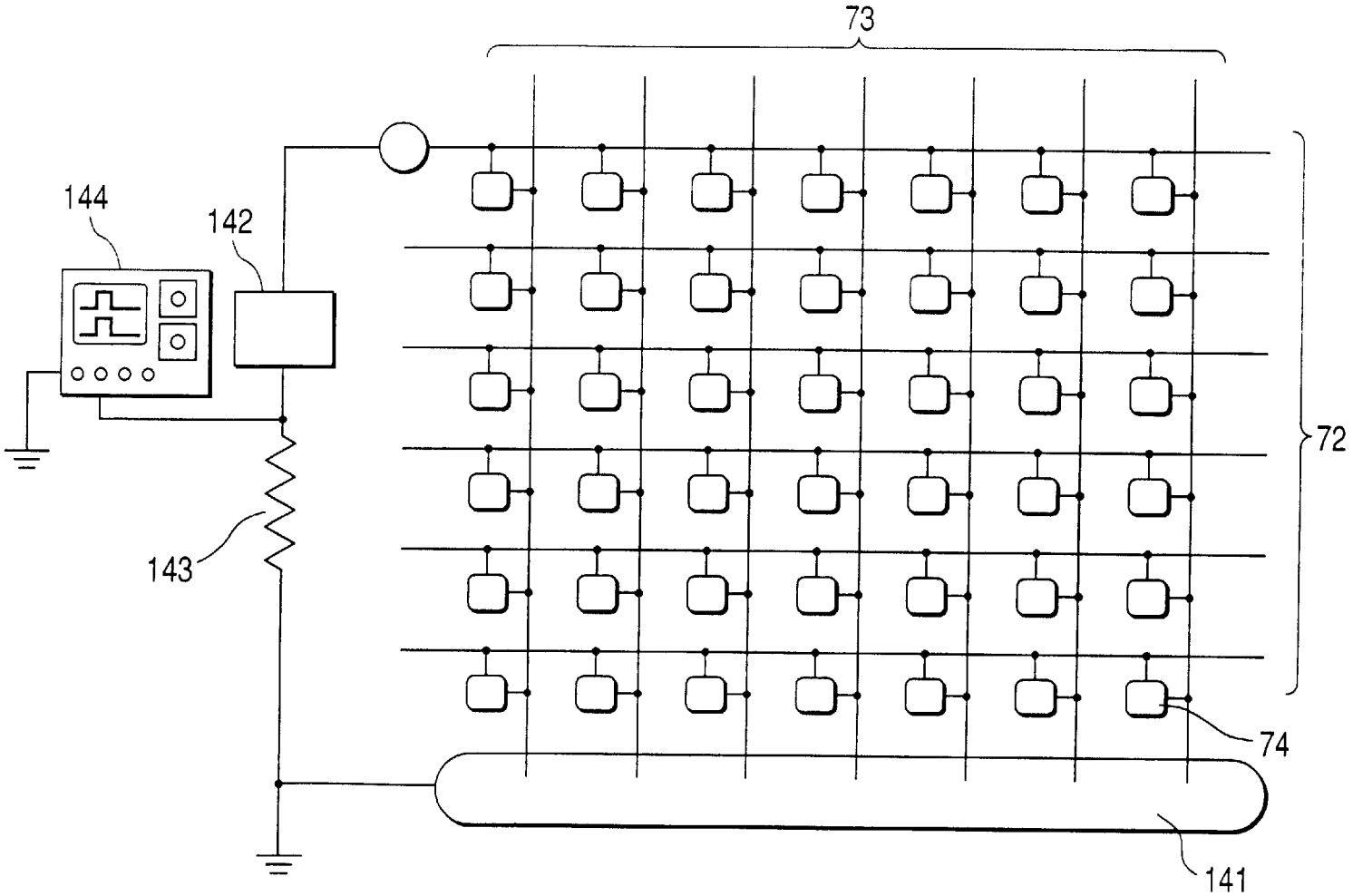
FIG. 10 is a drawing to show a forming apparatus according to the present invention.

Subsequently, the forming step is carried out to form the electron emission sections in the conductive film between the device electrodes produced on the electron-source substrate described above. On this occasion, for example as shown in FIG. 10, forming can be done on the conductive film between the device electrodes by connecting the Y-directional wires 73 to the common electrode 141 and simultaneously applying voltage pulses from a power supply 142 between the device electrodes of the devices connected to one wire out of the X-directional wires 72. The form of the pulse and conditions for judgment of completion of the operation are properly selected as occasion may demand. It is also possible to effect batch forming of the devices connected to plural X-directional wires by successively applying (or scrolling) pulses with shifted phases to the plural X-directional wires. In the drawing numeral 143 indicates a resistor for measurement of current and 144 an oscilloscope for measurement of current.

Figure 11A:
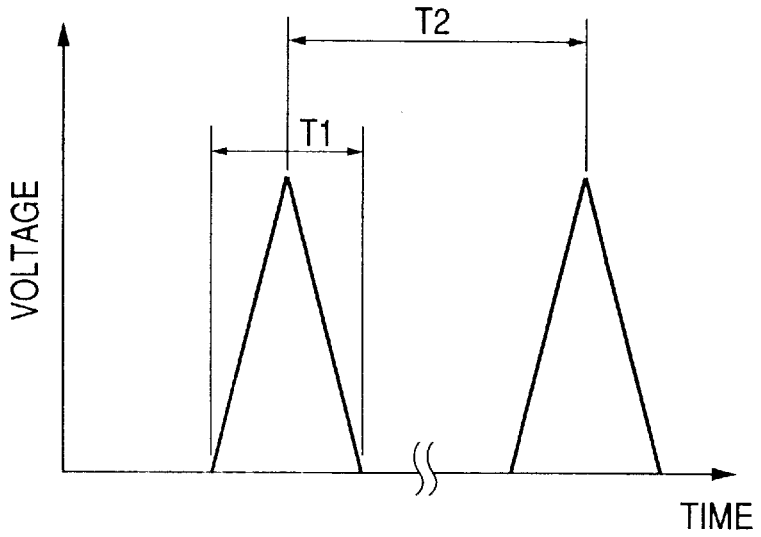
FIG. 11A is a drawing to show an example of voltage waveform in energization forming operation according to the present invention and FIG. 11B is a drawing to show another example of voltage waveform in the energization forming operation.
Figure 11B:
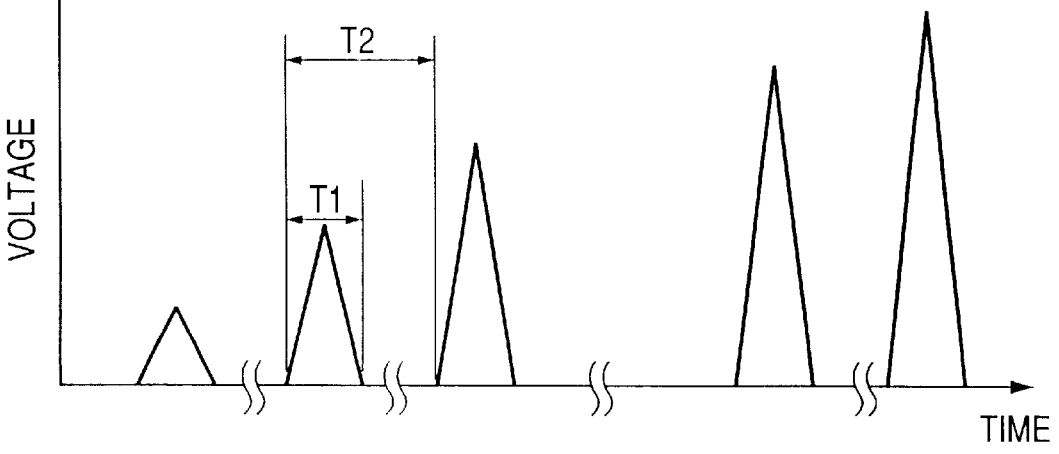

Examples of voltage waveforms in the energization forming are shown in FIGS. 11A and 11B.

The voltage waveforms are preferably pulse waveforms. In this case there are a technique for continuously applying pulses having pulse peak values of constant voltage as shown in FIG. 11A and a technique for applying voltage pulses with increasing pulse peak values as shown in FIG. 11B.

In FIG. 11A, T1 and T2 represent a pulse width and a pulse separation of the voltage waveforms. Normally, T1 is set in the range of 1 $\mu$sec to 10 msec and T2 in the range of 10 $\mu$sec to 100 msec. The peak value of the triangular waves (the peak voltage during the energization forming) is properly selected depending upon the form of the surface conduction electron-emitting device. Under these conditions, the voltage is applied, for example, for several seconds to several ten minutes. The pulse waveforms are not limited to the triangular waves, but a desired waveform such as a rectangular wave can also be employed.

As shown in FIG. 11B, the peak values of the triangular waves (peak voltages during the energization forming) can be increased, for example, in steps of about 0.1 V. Completion of the energization forming operation can be detected by applying a voltage during the pulse separation T2 and measuring a current. For example, the voltage of about 0.1 V is applied, the device current flowing at that time is measured to calculate a resistance, and the energization forming is ended with the resistance of not less than 1 MΩ. The forming operation as described above forms the clearance (fissure) in the conductive film between the device electrodes, and with application of a voltage between the device electrode electrons are emitted from the vicinity of the clearance.

6) Activation

Figure 12A:
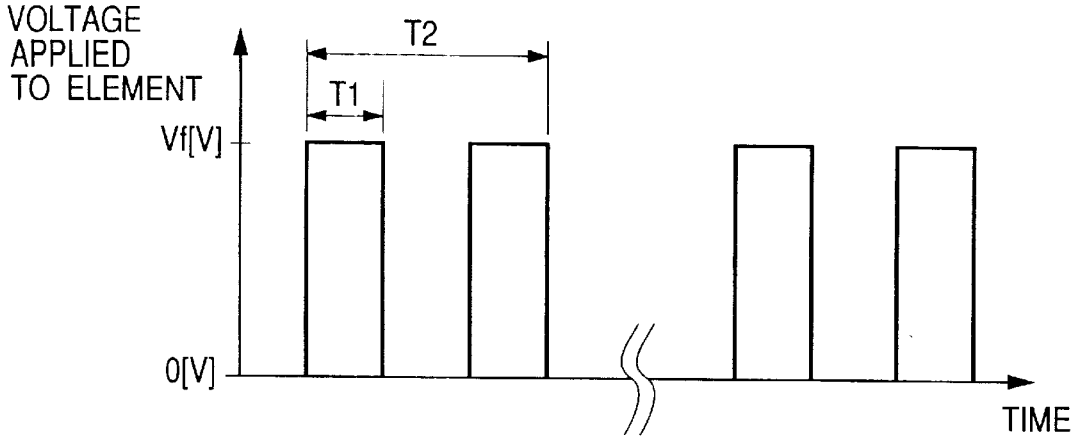
FIG. 12A, FIG. 12B, and FIG. 12C are drawings each to show an example of waveform in aging operation of the present invention, in activation operation according to the present invention, and in the normal driving according to the present invention, respectively.
Figure 12B:
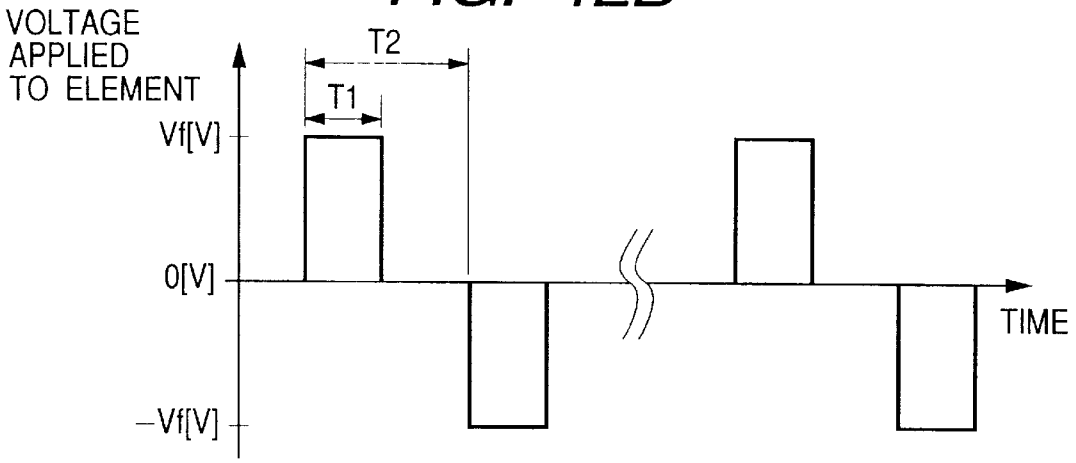

Subsequent to the above-stated forming, the activation operation is carried out to deposit a film of carbon or a carbon compound (6 in FIGS. 2A and 2B) at and near the aforementioned clearance. The activation step can be carried out, for example, by sufficiently evacuating the inside of the envelope 88, introducing a gas of an organic substance through the gas inlet line 1138 and through the exhaust pipe into the envelope, and repetitively applying pulses. This gas of the organic substance can be formed by utilizing an organic gas remaining in the ambience after evacuation for example by an oil diffusion pump or a rotary pump, or by sufficiently evacuating the inside into a vacuum by an ion pump and introducing a gas of an adequate organic substance into the vacuum. The preferred pressure of the gas of the organic substance differs depending upon the shape of the vacuum vessel, the kind of the organic substance, and so on, and is thus properly set depending upon the case. The appropriate organic substance can be selected from aliphatic hydrocarbons represented by alkane, alkene, and alkyne, aromatic hydrocarbons, alcohols, aldehydes, ketones, amines, organic acids such as phenol, carboxylic acid, and sulfonic acid, and so on. Specific examples of the organic substance include saturated hydrocarbons represented by $C_nH_{2n+2}$, such as methane, ethane, and propane, unsaturated hydrocarbons represented by the composition formula of $C_nH_{2n}$ or the like, such as ethylene and propylene, benzene, benzonitrile, tri-nitrile, toluene, methanol, ethanol, formaldehyde, acetaldehyde, acetone, methyl ethyl ketone, methyl amine, ethyl amine, phenol, formic acid, acetic acid, propionic acid, and so on. By this operation, carbon or the carbon compound is deposited from the organic substance present in the ambience onto the device, so as to bring about extreme change in the device current If and the emission current Ie. The waveform of the voltage pulses used for the activation operation can be selected arbitrarily, for example, from rectangular waves, triangular waves, sine waves, trapezoid waves, and so on. There are a technique for always applying pulses of one polarity as shown in FIG. 12A and a technique for alternately applying pulses of opposite polarities as shown in FIG. 12B; as to the surface conduction electron-emitting devices used in the present invention, it is more preferable to use the voltage pulses of the type of FIG. 12B having the both of the positive and negative polarities.

After the above activation operation employing a technique of keeping the peak values of the voltage pulses (activation voltage Vact) at a constant voltage or a technique of gradually increasing the voltage with time, or the like, the device voltage is applied to the surface conduction electron-emitting devices to allow the current to flow in the device surface, whereby the devices emit a sufficient quantity of electrons from the electron-emitting sections. A voltage-applying method at this time employs the same connection as in the case of the above forming and is achieved by simultaneously applying the voltage pulses between the device electrodes of the devices connected to one directional wire.

Figure 2A:
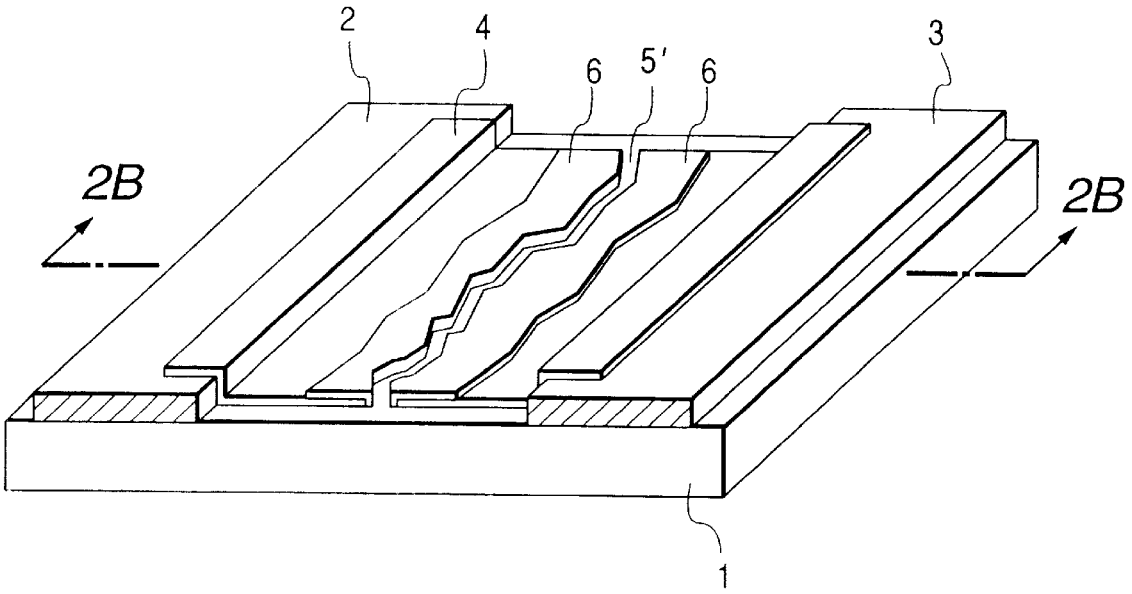
FIG. 2A is a perspective view to show the structure of another surface conduction electron-emitting device applied to the present invention and FIG. 2B is a sectional view thereof along 2B—2B.
Figure 2B:
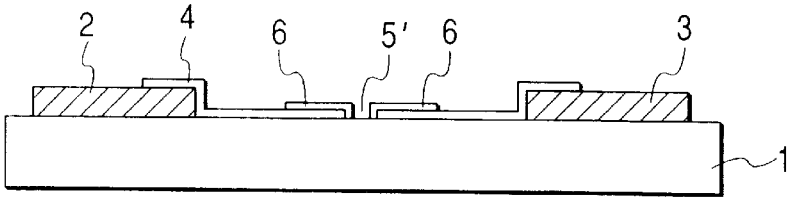

The above step forms a narrower gap 5' in the film 6 of carbon or the carbon compound inside the clearance of the conductive film 4 as shown in FIGS. 2A and 2B, which enhances electron emission efficiency. In FIGS. 2A and 2B the members with the same reference symbols as in FIGS. 1A and 1B denote the same members.

7) Stabilization

It is desirable to perform the following stabilization step after the activation. This step is a step of exhausting the organic substance in the vacuum vessel. The pressure of the vacuum section in the envelope is preferably not more than $1\times10^{-5}$ Pa and more preferably not more than $1\times10^{-6}$ Pa. The evacuation unit for evacuating the envelope is preferably one not using oil in order to prevent the oil generated from the unit from affecting the characteristics of device. Specifically, the evacuation unit can be selected, for example, from a sorption pump, an ion pump, and so on. During evacuation of the inside of the vacuum vessel, the whole vacuum vessel is preferably heated to facilitate exhaust of the organic molecules adsorbing to the inner wall of the vacuum vessel and to the electron-emitting devices. The heating at this time is carried out preferably at 100–300° C. and for as longer time as possible, but, without having to be limited to these conditions, the conditions are properly selected depending upon various conditions including the size and shape of the vacuum vessel, the structure of the electron-emitting devices, and so on. After completion of the stabilization step as described above, the organic substance is fully removed from the vacuum section, so as to suppress new deposition of carbon or the carbon compound, so that the device current If and emission current Ie are stabilized.

8) Encapsulation/Getter

After the stabilization operation, the exhaust pipe not illustrated is heated by a gas burner to be fused, thereby encapsulating the envelope. A getter operation can also be performed in order to maintain the pressure in the panel after the encapsulation of the envelope 88. This is a process for forming a deposit film by heating a getter placed at a predetermined position (not illustrated) in the envelope 88 by heat using resistance heating or high-frequency heating, immediately before or after the encapsulation of the envelope 88. The getter normally contains a principal component of Ba or the like, and maintains, for example, the pressure of $1\times10^{-4}$ to $1\times10^{-7}$ Pa by the adsorption action of the deposit film.

9) Aging Step

After the encapsulation and getter flash, the aging step is carried out for the panel container produced as described above. The aging is effected after the encapsulation herein, but it may be carried out before the encapsulation, i.e., after the stabilization. In a preferred embodiment the aging step of the present invention is carried out after the getter flash in particular.

Figure 13:
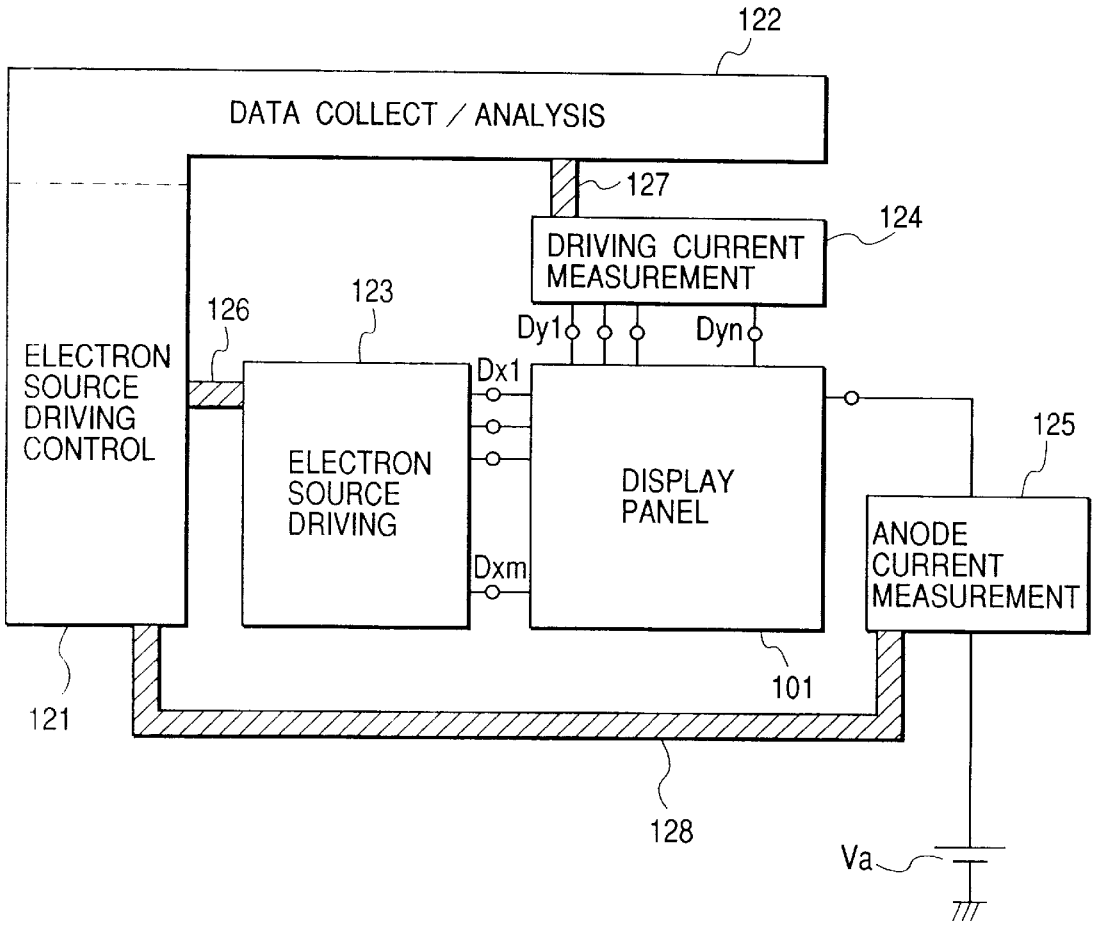
FIG. 13 is a drawing to show an aging technique and aging apparatus according to the present invention.

The aging step and aging apparatus in the present invention will be described by reference to FIG. 13. FIG. 13 is a schematic diagram of the aging apparatus for carrying out the aging step in the present invention for the panel container 101 of the image-forming apparatus under the above-stated production process. Inside the panel container 101 under the production process there are the substrate in which the electron source having the plural electron-emitting devices is positioned, and the image-forming member disposed opposite to the substrate provided with the electron source. An electron-source driving device is connected to the electron source through terminals outside the panel container and a high-voltage supply (anode supply) Va for acceleration of electron beam is connected to the image-forming member. The electron-source driving device 123 is a unit for applying a desired device voltage to the electron-emitting devices arrayed on the electron-source substrate and is controlled by electron-source driving control unit 121, whereby the driving voltage Vf, driving pulse width, driving scan frequency, the number of driven devices, etc. can be set arbitrarily. The driving scan frequency herein is a frequency in the driving with successive switch of driving lines. A driving signal bus 126 connects the electron-source driving control unit 121 to the electron-source driving unit 123 to transmit the driving signal and control signal. The high-voltage supply (anode supply) Va is a unit for applying the anode voltage to the image-forming member. In addition to the above, additional devices can also be provided, including a driving current measuring unit 124 for measuring the current (mainly the device current) flowing in the electron-source substrate during driving of the electron source, an anode current measuring unit 125 for measuring the current (mainly the emission current) flowing between the electron-source substrate and the image-forming member, and so on. Each of the driving current measuring unit 124 and the anode current measuring unit 125 can transmit data of measured current values through a device current signal bus 127 and through an emission current signal bus 128 to a data collecting/analyzing unit 122. The operations of the electron-source driving control unit 121 and the data collecting/analyzing unit 122 can also be synchronized with each other by a synchronous signal; in this case, an integral device having the both functions may be constructed and used instead thereof.

The aging step using the above aging apparatus will be described with an example of the panel container 101 using the electron source in which the surface conduction electron-emitting devices described previously are arrayed in the simple matrix layout.

Outside the panel container 101 there are provided the external terminals for electrically being connected to the X-directional wires and to the Y-directional wires as the wires of the simple matrix described previously. For example, the electron-source driving unit 123 is connected through the external terminals to the X-directional wires, while the driving current measuring unit 124 similarly to the Y-directional wires. The anode current measuring unit 125 and anode supply Va are connected through an anode terminal for electrical connection to the image-forming member provided in the panel container.

When the voltage over the threshold voltage Vth for electron emission described previously is applied from the electron-source driving unit 123 between the X-directional wires and the Y-directional wires under the above circumstances, electrons are emitted from the electron-emitting devices; when a voltage positive with respect to the X-directional wires and Y-directional wires is applied to the anode terminal, the electrons emitted from the electron-emitting devices can be made to collide with the face plate. During the final image formation, the relation of the polarity of the potential applied to the X-directional wires with respect to the potential on the Y-directional wires can be either positive or negative as long as a good image is obtained; however, in the present embodiment the potential relation of the voltage applied to the devices for electron emission during the final image formation (i.e., during the normal driving) is selected so that the potential of the second device electrodes connected to the Y-directional wires is positive with respect to the first device electrodes of the electron-emitting devices connected to the X-directional wires.

In the aging step in the present invention, the devices for electron emission are driven during the aging step by applying the voltage of the opposite polarity to that of the voltage during the aforementioned normal driving. Describing it following the previous example, the voltage signal outputted from the electron-source driving unit 123 is set in such potential relation of the voltage applied to the devices for electron emission that the potential of the second device electrodes connected to the Y-directional wires is negative with respect to that of the first device electrodes of the electron-emitting devices connected to the X-directional wires.

Figure 14:
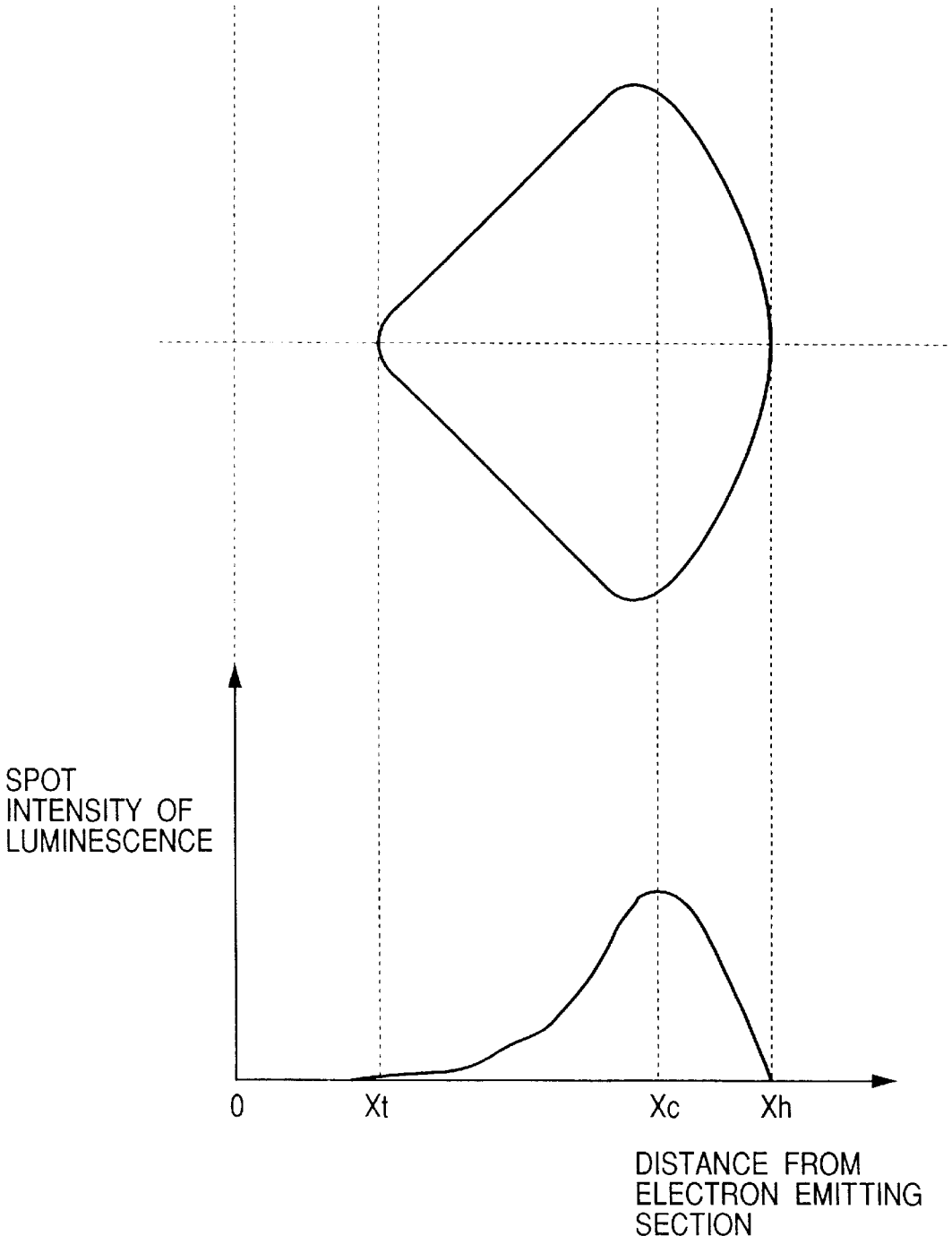
FIG. 14 is a drawing to show the shape of a luminous spot observed in the surface conduction electron-emitting device, and the relation between distance from the electron-emitting section and spot intensity of luminescence.
Figure 15A:
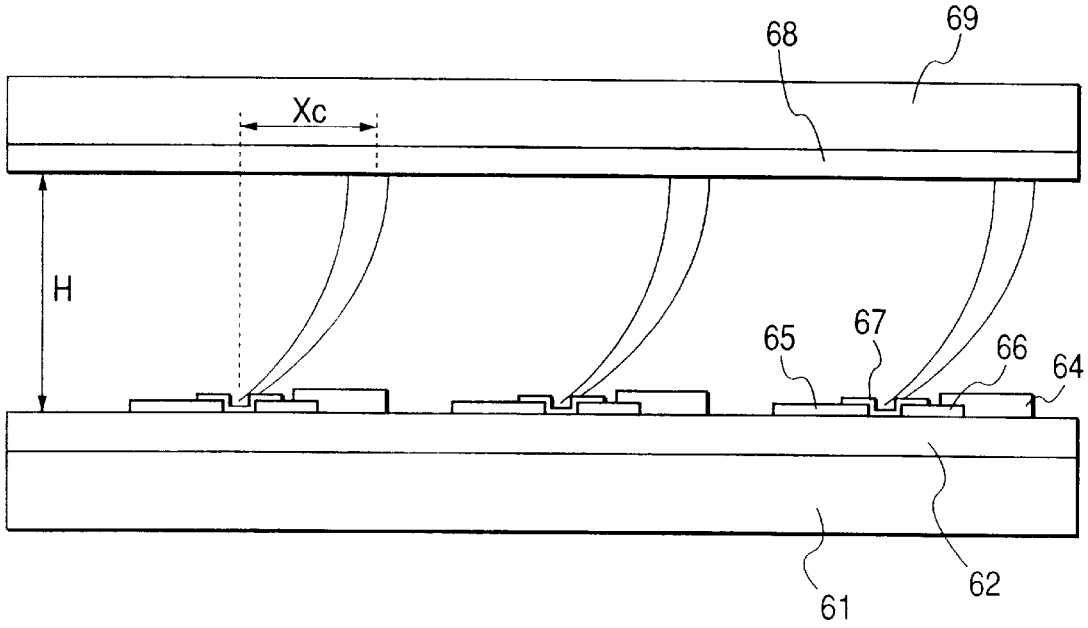
FIG. 15A and FIG. 15B are drawings to show trajectories of electron beams in the image-forming apparatus to which the present invention is applicable.
Figure 15B:
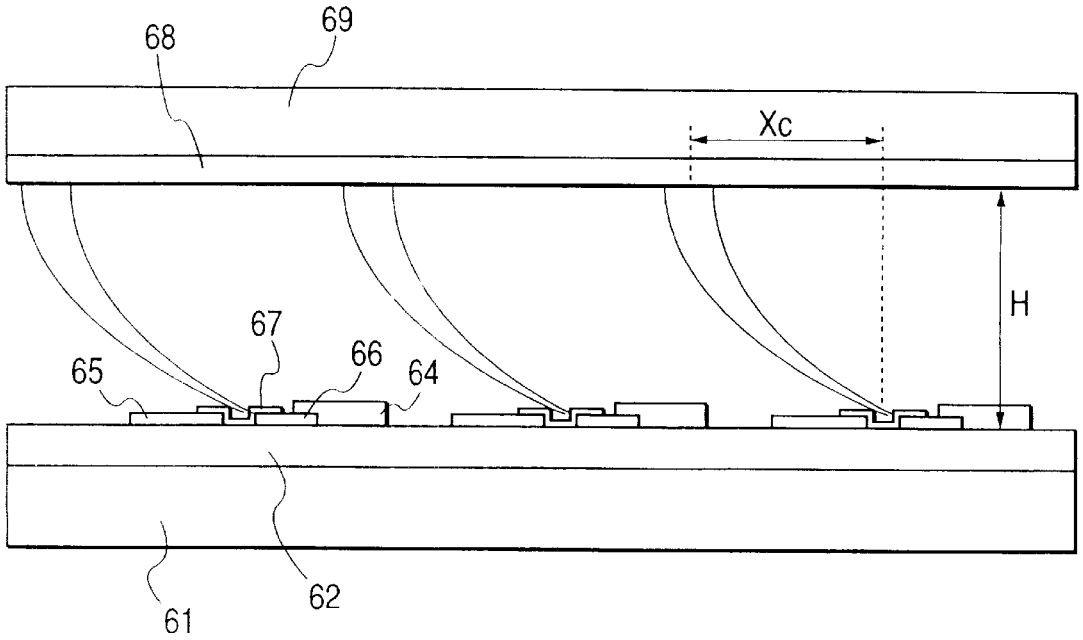

Next described referring to FIG. 14 and FIGS. 15A and 15B are trajectories of electron beams inside the panel during the normal driving and during the aging. FIG. 14 is a drawing to show the shape of a luminous spot observed in the surface conduction electron-emitting device described previously, and the relation of spot intensity of luminescence with the distance from an intersecting point between the anode electrode and the normal to the electron-emitting section in the direction of connection between the device electrodes. FIGS. 15A and 15B are schematic, sectional views of the electron-emitting sections cut along the direction of the X-directional wire to show the section of the panel container 101 using the electron source in which the aforementioned surface conduction electron-emitting devices are arrayed in the simple matrix layout. FIG. 15A is an imaginary diagram of trajectories of electron beams during the normal driving and FIG. 15B an imaginary diagram of trajectories of electron beams during the aging. These electron beam trajectories were drawn based on experimental results and numerical computation by the finite element method using a simplified structure. Although FIGS. 15A and 15B are drawings valid only for the specific panel structure and potential relation, the electron beam trajectories in the aging step of the present invention are not limited to this example, and prescription of beam trajectories is also possible for other structures, including the so-called grid structure in which the control electrode is provided in the upper space of the electron source as described previously, for example. The following description will be given using FIGS. 15A and 15B and based on the second electrode potential defined as the reference potential (0 V in this case) for simplicity of description.

In FIGS. 15A and 15B numeral 61 designates the substrate made of an electrically insulative material, 62 an electrically insulative layer for electrical insulation between the X-directional wires and the Y-directional wires, 64 the Y-directional wires, 65 the first device electrodes of the electron-emitting devices, 66 the second device electrodes of the electron-emitting devices, and 67 the electron-emitting sections. The second device electrode 66 is connected directly to the Y-directional wire 64, and the first device electrode 65 is connected through a contact hole to the X-directional wire. Numeral 68 denotes the image-forming member and 69 the glass substrate, and the image-forming member 68 and electron emission sections 67 are the distance H apart from each other with the vacuum area in between.

Figure 12C:
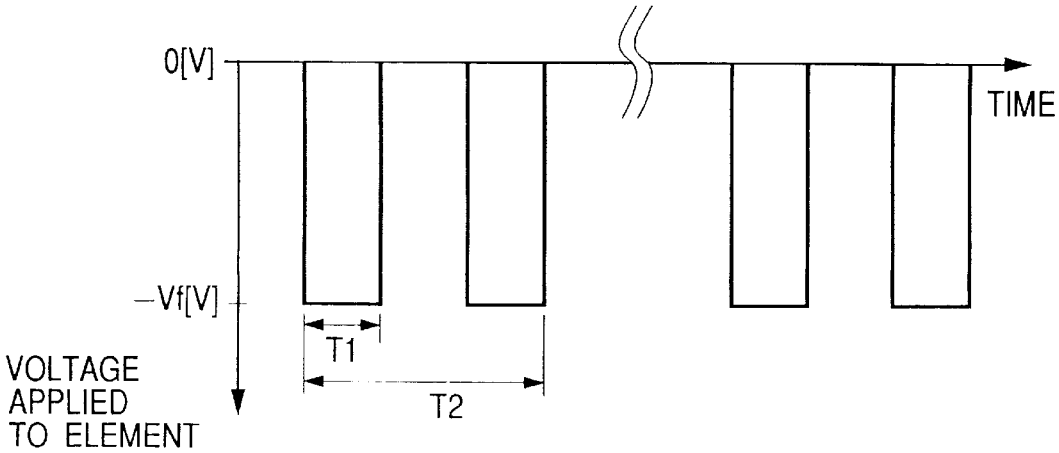

FIG. 15A illustrates the electron beam trajectories during the image formation (or during the normal driving), in which the potential of the first device electrodes 65 is so set as to be negative and as to establish a voltage over the threshold voltage for electron emission (for example, the voltage pulses as shown in FIG. 12C are applied). A dc voltage of a higher potential than that of the first device electrodes 65 is applied to the image-forming device (the voltage will be referred to as the anode electrode). FIG. 15B illustrates the electron beam trajectories during the aging step of the present invention, and a difference from FIG. 15A is that the polarity of the voltage applied to the first device electrodes 65 is positive (for example, the voltage pulses as shown in FIG. 12A are applied thereto). As apparent from FIG. 15A and FIG. 15B, the beam spot positions of the electron beams colliding with the image-forming member 68 are shifted to the higher-potential electrode side, either the first device electrode side or the second device electrode side, from the intersecting point between the anode electrode and the normal to the electron-emitting section 67.

When in the normal driving the high voltage of several kV to ten and several kV is applied to the anode electrode to effect the image display, the electrons emitted from the electron-emitting sections 67 are accelerated by the anode electrode to collide at the beam spot positions described above and promote desorption of gas from the image-forming member 68. With desorption of gas, positive ions (mainly, ionized gas molecules) are generated, and the positive ions are accelerated by the high potential to collide with the members etc. forming the electron source, so that desorption of gas may also be caused by this collision of the ions in some cases. On this occasion, the quantity of emission current from the electron-emitting devices decreases with driving, because the gas emitted from the image-forming member 68 and electron-source components contains a gas that degrades the characteristics of the electron-emitting devices. Particularly, the degradation of the characteristics of the electron-emitting devices is great when the image-forming member 68 is first bombarded with the electron beams during production or after production of the panel container 101. It is thus speculated that a lot of gas is desorbed in the early stage of driving.

The aging step in the present invention is a step of first making the degrading gas described above preliminarily desorbed from the image-forming member 68, prior to the image formation by the normal driving and removing it by the getter disposed in the panel container or by the evacuation unit outside the panel container. The principal feature of the aging step is to invert the polarity of the voltage applied to the electron-emitting devices during the aging step from that during the aforementioned image formation. This will achieve the electron emission characteristics during the image formation nearly equivalent to those of the electron-emitting devices before the aging step, even if the characteristic degradation of the electron-emitting devices occurs due to the desorbed gas in the aging step. Concerning this, the aging step can be understood as follows. Electron-emitting sites now emitting electrons are more likely to be affected by the aforementioned desorbed gas. Further, the electron-emitting sites in the electron-emitting devices also vary with the change in the direction of the electric field between the pair of electrodes of the electron-emitting devices due to the inversion of polarity. Even if the electron-emitting sites emitting electrons during the aging step are deteriorated, the above inversion of polarity will cause electrons to be emitted during the image formation from the other electron-emitting sites that are little affected by the desorbed gas, than those during the aging step; therefore, the electron emission characteristics nearly equivalent to those of the electron-emitting devices before the aging step are achieved.

The beam spot positions described previously differ depending upon the voltage applied to the electron-emitting devices, the voltages applied to the control electrode and to the anode electrode, the material and size of the electron-source substrate, and so on, but the beam spot positions in the aforementioned simple matrix structure can be described by Equation 1.

(Equation 1)

$$Xc=A\cdot H\cdot\sqrt{(Vf/Va)}$$

In Equation 1, Xc is the distance from the intersecting point between the anode electrode and the normal to the electron-emitting section to a beam spot position in the direction of connection between the device electrodes, H the distance between the electron-emitting devices and the anode electrode, Vf the voltage applied between the device electrodes, Va the voltage applied to the anode electrode, and A a proportional constant determined according to the material and structure of the electron-source substrate etc., which is, for example, A=2.0 in the case where the image-forming apparatus is produced in the simple matrix structure and the positional relation is measured of the beam spots with Vf and Va.

The beam spot position Xc is represented by a position of the highest beam intensity as illustrated in FIG. 14, but a luminous spot (a colliding position of electron beam) itself has some spread. Then, let Xh represent the farthest position from the intersecting point between the anode electrode and the normal to the electron-emitting section and Xt represent the closest position. Values of Xh and Xt can be indicated by putting 2.33 and 0.95, respectively, into A in Equation 1. Among the directions of connection between the device electrodes, the direction toward the higher-potential device electrode is positive in FIG. 14.

Preferred driving conditions of the aging step in the present invention are as follows; Vf and/or Va is properly selected so that some or all of the beam spot positions Xc during the aging (=Xca) become equal to some or all of the beam spot positions Xc during the image formation (during the normal driving) (=Xcp). This achieves positive desorption of gas in the beam spot areas during the normal driving. For example, in the simple matrix structure in the present embodiment, Vf and/or Va is selected so as to satisfy the following equation:

(Equation 2)

$$n\cdot p=2H\sqrt{(Vf/Va)}+2H\sqrt{(Vfp/Vap)}$$

where p is the X-directional (horizontal in FIGS. 15A and 15B) pitch of the plurality of arrayed electron-emitting devices, n a positive integer, Vfp the driving voltage of electron-emitting device applied during the image formation, and Vap the voltage applied to the image-forming member during the image formation.

It is also possible to carry out a process including a combination of driving voltage conditions corresponding to a plurality of different, positive integers n during one aging operation.

The degassing operation can be perfectly performed when Vf and/or Va is modulated so that the beam spot positions Xca during the aging step irradiate the range of from the head Xh to the tail Xt of the luminous spot during the image formation, in addition to the above-stated condition that the beam spot positions Xc of the maximum electron beam intensities are equally aligned (Xca=Xcp) as described above.

Namely, the aging step is carried out while modulating Vf and/or Va so as to satisfy the following equation.

(Equation 3)

$$n\cdot p/(2H)-1.165\cdot\sqrt{(Vfp/Vap)}\leqq\sqrt{(Vf/Va)}\leqq n\cdot p/(2H)-0.475\cdot\sqrt{(Vfp/Vap)}$$

This driving method may also employ the process including a combination of driving voltage conditions corresponding to a plurality of different, positive integers n during one aging operation.

A further preferred driving condition of the aging step in the present invention is as follows: the electron source Va during the aging is controlled to the voltage of +500 to +1000 V or less. This can minimize the damage to the electron-source substrate and the other components due to the discharge caused by increase in the pressure in the panel container with the desorption of gas during the aging. It is clear that the aging effect is sufficiently demonstrated by the acceleration voltage of about +500 to +1000 V, for example, from the fact that little increase is seen in the cross section of desorption of gas at the electron energy of +400 eV and above, as disclosed in M. Nishijima and F. M. Propst: Phys. Rev., B2 (1970) 2368 and other literatures.

Next described referring to FIG. 8 is the structure of the driving circuit for effecting the TV display based on the TV signals of the NTSC method on the display panel constructed using the electron source of the simple matrix layout produced as described above. In FIG. 8, numeral 101 designates the image display panel, 102 a scanning circuit, 103 a control circuit, and 104 a shift register. Numeral 105 denotes a line memory, 106 a synchronous signal separator, 107 a modulation signal generator, and Vx and Va dc voltage supplies.

The present driving circuit is adapted to perform the normal driving for image display and also perform driving of the display panel by the opposite polarity to that in the normal driving, for carrying out the aging step by the present circuit.

The display panel 101 is connected to the external, electric circuits through terminals Dox1 to Doxm, terminals Doy1 to Doyn, and a high-voltage terminal Hv. Applied to the terminals Dox1 to Doxm are scanning signals for successively driving the electron source provided in the display panel, i.e., a group of surface conduction elecron-emitting devices matrix-wired in a matrix of M rows×N columns row by row (every N devices).

Applied to the terminals Dy1 to Dyn are modulation signals for controlling an output electron beam from each of surface conduction electron-emitting devices in a row selected by the scanning signal. The dc voltage, for example, of 10 kV is supplied from the dc voltage supply Va to the high-voltage terminal Hv, and this is the acceleration voltage for imparting sufficient energy for excitation of the fluorescent members to the electron beams outputted from the surface conduction electron-emitting devices.

During the aging the value of Va can be set to the voltage of about +500 to +1000 V.

The scanning circuit 102 will be described below. This circuit is provided with M switching devices inside (which are schematically indicated by S1 to Sm in the drawing). Each switching device selects either the output voltage of the dc voltage supply Vx or 0 V (the ground level) to be electrically connected to the terminal Dx1 to Dxm of the display panel 101. Each switching device of S1 to Sm operates based on the control signal Tscan outputted from the control circuit 103, and can be constructed of a combination of such switching devices as FETs, for example.

The dc voltage supply Vx can set the voltage in either polarity, positive or negative.

The dc voltage supply Vx in the present example is so set as to output such a constant voltage that the driving voltage applied to the devices not scanned based on the characteristics (the electron emission threshold voltage) of the surface conduction electron-emitting devices is not more than the electron emission threshold voltage.

The control circuit 103 has a function to match operations of the respective sections so as to achieve the appropriate display based on the image signals supplied from the outside. The control circuit 103 generates each control signal of Tscan, Tsft, and Tmry to each section, based on the synchronous signal Tsync sent from the synchronous signal separator 106.

The synchronous signal separator 106 is a circuit for separating a synchronous signal component and a luminance signal component from the TV signal of the NTSC method supplied from the outside, which can be constructed using an ordinary frequency separator (filter) circuit or the like. The synchronous signal separated by the synchronous signal separator 106 is composed of a vertical synchronous signal and a horizontal synchronous signal, but it is illustrated as a Tsync signal herein for convenience' sake of description. The luminance signal component of image separated from the aforementioned TV signal is indicated by DATA signal for convenience' sake. The DATA signal is input into the shift register 104.

The shift register 104 is a register for performing serial/parallel conversion for each line of image of the aforementioned DATA signal serially input in time series, which operates based on the control signal Tsft sent from the control circuit 103 (this means that the control signal Tsft can be said to be a shift clock of the shift register 104). The data of each image line after the serial/parallel conversion (corresponding to the driving data for the N electron-emitting devices) is outputted as N parallel signals of Id1 to Idn from the shift register 104.

The line memory 105 is a storage device for storing the data of one image line during a necessary period, which properly stores the data of Id1 to Idn according to the control signal Tmry sent from the control circuit 103. The stored data is outputted as I'd1 to I'dn to the modulation signal generator 107.

The modulation signal generator 107 is a signal source for properly modulating driving of the surface conduction electron-emitting devices according to each of the image data I'd1 to I'dn, and output signals therefrom are applied through the terminals Doy1 to Doyn to the surface conduction electron-emitting devices in the display panel 101.

As described previously, the electron-emitting devices, to which the present invention can be applied, have the following fundamental characteristics concerning the emission current Ie. Specifically, there is the definite threshold voltage Vth for electron emission, so that electron emission occurs only upon application of the voltage over Vth. With voltages over the electron emission threshold, the emission current also varies according to change in the voltage applied to the device. It is seen from this fact that when pulses of the voltage are applied to the present devices, no electron emission occurs with application of the voltage below the electron emission threshold, but the electron beams are outputted with application of the voltage over the electron emission threshold, for example. On that occasion, the intensity of output electron beam can be controlled by changing the peak value Vm of the pulses. It is also possible to control a total amount of charge of the output electron beam by changing the width Pw of the pulses.

Accordingly, the voltage modulation method, the pulse width modulation method, or the like can be employed as a method for modulating the electron-emitting devices according to the input signal. For carrying out the voltage modulation method, the modulation signal generator 107 can be a circuit of the voltage modulation method for generating voltage pulses of a constant length and properly modulating peak values of the pulses according to input data.

For carrying out the pulse width modulation method, the modulation signal generator 107 can be a circuit of the pulse width modulation method for generating voltage pulses of a constant peak value and properly modulating widths of the voltage pulses according to the input data.

The shift register 104 and the line memory 105 can be of either the digital signal type or the analog signal type. The point is that the serial/parallel conversion and storage of image signal should be carried out at a predetermined rate.

For use of the digital signal type, the output signal DATA of the synchronous signal separator 106 needs to be digitized. For this purpose, the output section of 106 is provided with an A/D converter. In connection with it, the circuit used in the modulation signal generator 107 will slightly differ depending upon whether the output signals of the line memory 105 are digital signals or analog signals. In the case of the voltage modulation method using digital signals, the modulation signal generator 107 is, for example, a D/A converter and an amplifier is added if necessary. In the case of the pulse width modulation method, the modulation signal generator 107 is a circuit, for example, comprised of a high-speed oscillator, a counter for counting waves outputted from the oscillator, and a comparator for comparing an output value of the counter with an output value of the memory. The circuit may also be provided with an amplifier for amplifying the voltage of the modulation signal modulated in the pulse width from the comparator to the driving voltage of the surface conduction electron-emitting devices, if necessary.

In the case of the voltage modulation method using analog signals, the modulation signal generator 107 can be an amplifying circuit, for example, using an operational amplifier and may also be provided with a level shift circuit if necessary. In the case of the pulse width modulation method, a voltage-controlled oscillator (VCO) can be employed, for example, and it can also be provided with an amplifier for amplifying the voltage to the driving voltage of the surface conduction electron-emitting devices, if necessary.

In the image-forming apparatus to which the present invention can be applied and which can be constructed as described above, electron emission occurs when the voltage is applied through the terminals Dox1 to Doxm, Doy1 to Doyn outside the container to each electron-emitting device. The electron beams are accelerated by applying the high voltage through the high voltage terminal Hv to the metal back 85 or to the transparent electrode (not illustrated). The electrons thus accelerated collide with the fluorescent film 84 to bring about luminescence, thus forming the image.

It should be noted that the structure of the image-forming apparatus stated herein is just an example of the image-forming apparatus to which the present invention can be applied, and it can involve a variety of modifications based on the technological thought of the present invention. Although the NTSC method was exemplified for the input signals, the input signals can be of the PAL method, the SECAM method, or the like, or a method of TV signals including more scanning lines (for example, one of high-definition TV methods including the MUSE method) without having to be limited to the NTSC method.

The image-forming apparatus of the present invention can be applied to display devices for television broadcasting system, display devices for television conference systems, computers, and so on, image-forming apparatus as an optical printer constructed using a photosensitive drum etc., and so on.

EXAMPLES

The present invention will be further described in detail with specific examples, but it should be noted that the present invention is by no means intended to be limited to these examples and that the present invention also involves substitutes and design changes of each element within the scope achieving the object of the present invention.

Example 1

The present example is an example in which the aging step according to the present invention is carried out prior to the getter flash and encapsulation steps by use of the manufacturing apparatus on the occasion of fabrication of the image-forming apparatus in which a lot of surface conduction electron-emitting devices are arrayed in the simple matrix layout on the electron-source substrate.

FIG. 13 is a schematic diagram of the aging apparatus for carrying out the aging step according to the present invention for the panel container 101 of the image-forming apparatus.

In FIG. 13, numeral 101 denotes the panel container, 121 the electron-source driving control unit, 122 the data collecting/analyzing unit, 123 the electron-source driving unit, 124 the driving current measuring unit, 125 the anode current measuring unit, 126 the driving signal bus, 127 the device current signal bus, and 128 the emission current signal bus.

In FIG. 13, numeral 101 represents the panel container of the image-forming apparatus shown in FIG. 6, in which the electron source of the image-forming apparatus is an electron source in which a lot of surface conduction electron-emitting devices are arrayed in the simple matrix layout (in a matrix of 100 rows×100 columns including the three colors), as schematically illustrated in FIG. 5. Production steps of the panel container will be described below.

<Production Steps of Panel Container>

There are described below production of the electron-source substrate, production of the image-forming member, and sealing/assembly being the steps in the early stage for production of the panel container.

Figure 16:
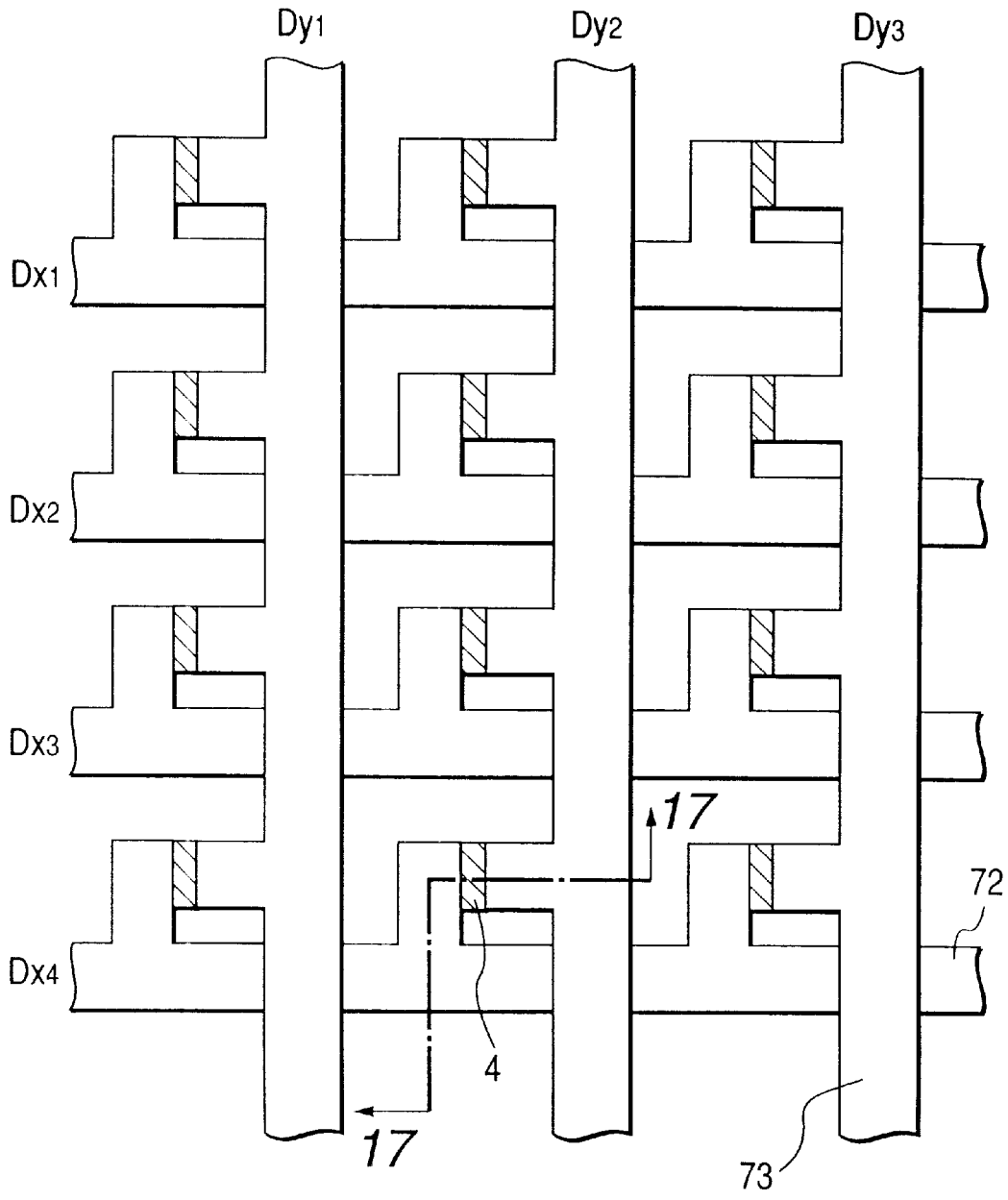
FIG. 16 and FIGS. 17A, 17B, 17C, 17D, 17E, 17F, 17G and 17H are drawings to explain fabrication steps in an example according to the present invention.

The electron-source substrate with a plurality of surface conduction electron-emitting devices described above is produced as follows. A plan view of the electron-source substrate produced according to the steps of this example is shown in FIG. 16 and sectional views along 17—17 are shown in FIGS. 17A to 17H. In the figures numeral 71 denotes the substrate, 72 the X-directional wires (also called lower wires), 73 the Y-directional wires (also called upper wires), 4 the electroconductive film, 2, 3 the device electrodes, 141 the interlayer insulation layer, and 142 the contact holes for electrical connection between the device electrode 2 and lower wire 72.

Next, the production steps will be described specifically according to the sequence of the steps by reference to FIGS. 17A to 17H.

Figure 17A:
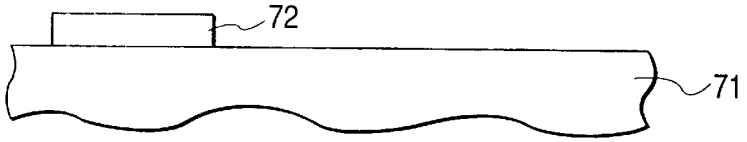

Step-a: A silicon oxide film 0.5 μm thick was deposited on a cleaned soda lime glass by sputtering to obtain the substrate 71. On this substrate 71, Ti and Au were successively deposited in the thickness of 50 Å and in the thickness of 6000 Å, respectively, by vacuum evaporation. Then a photoresist (AZ1370 available from Hoechst) was applied by spin coating with a spinner, followed by baking. After the baking, a photomask image was exposed and developed to form a resist pattern of the X-directional wires 72. Then the Au/Ti deposit film was subject to wet etching, thereby forming the X-directional wires 72 in the desired shape (FIG. 17A).

Figure 17B:
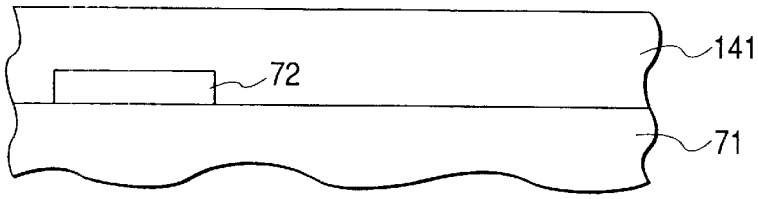

Step-b: The interlayer insulation layer 141 of a silicon oxide film 1.0 μm thick was then deposited by RF sputtering (FIG. 17B).

Figure 17C:
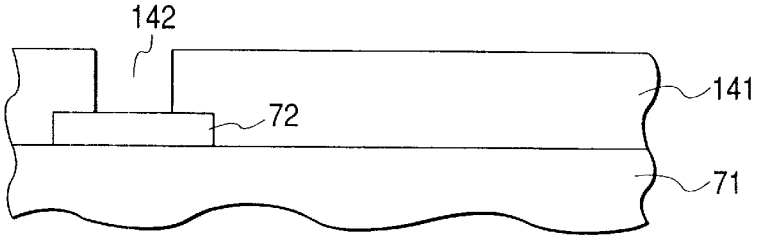

Step-c: A photoresist pattern for forming the contact holes 142 was then formed on the silicon oxide film deposited in the preceding step b and the contact holes 142 were formed using this as a mask by etching of the interlayer insulation layer 141. The etching was conducted by the RIE (Reactive Ion Etching) process using $CF_4$ and $H_2$ gases (FIG. 17C).

Figure 17D:
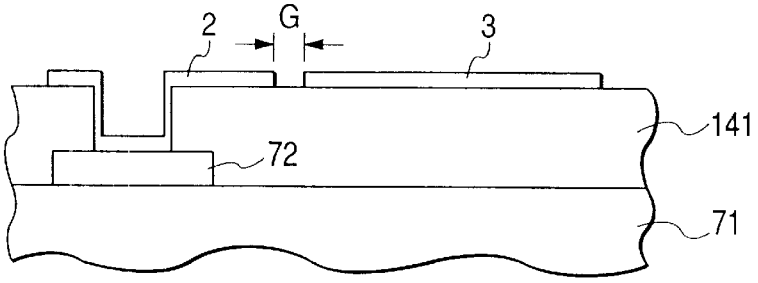

Step-d: Then a pattern to become the gaps G between the device electrode 2 and the device electrode 3 was formed by a photoresist (RD-2000N available from Hitachi Kasei), and Ti and Ni were successively deposited in the thickness of 50 Å and in the thickness of 500 Å, respectively, by vapor evaporation. Then the photoresist pattern was dissolved with an organic solvent and the Ni/Ti deposit film was subject to lift-off to form the device electrodes 2, 3 with the device electrode gap G of 3 μm and the width W1 of the device electrodes of 200 μm (FIG. 17D).

Figure 17E:
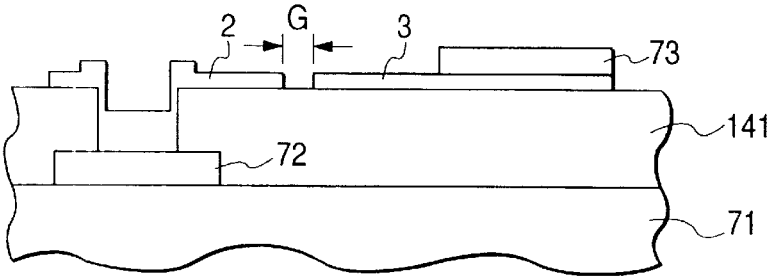

Step-e: A photoresist pattern for the Y-directional wires 73 was formed over the device electrodes 2, 3, Ti and Au were successively deposited in the thickness of 50 Å and in the thickness of 5000 Å, respectively, by vacuum evaporation, and unnecessary portions were removed by lift-off, thereby forming the Y-directional wires 73 in the desired shape (FIG. 17E).

Figure 17F:
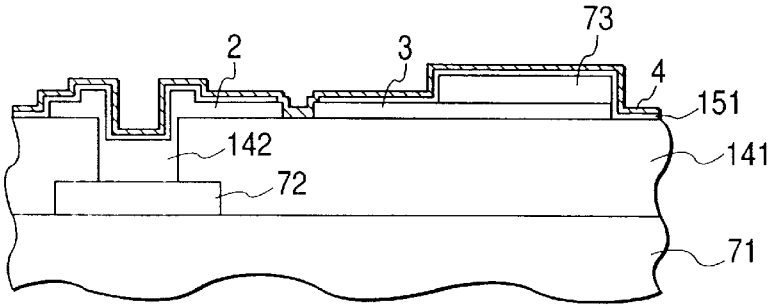

Step-f: Cr film 151 1000 Å thick was deposited by vacuum evaporation and then patterned, and organic Pd (ccp4230 available from Okuno Seiyaku K.K.) was applied thereonto by spin coating with a spinner, followed by a baking process at 300° C. for ten minutes. The thin film 4 for formation of electron-emitting sections mainly comprised of fine particles of PdO, thus formed, had the thickness of 85 Å and the sheet resistance of $3.9\times10^4$ Ω/□. (FIG. 17F)

Figure 17G:
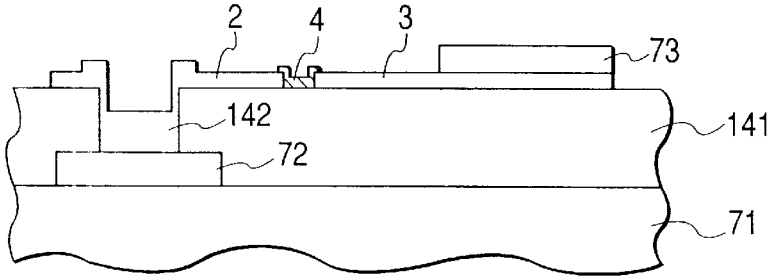

Step-g: A desired pattern was formed by etching the Cr film 151 and the thin film 4 for formation of electron-emitting sections after baked, with an acid etchant (FIG. 17G).

Figure 17H:
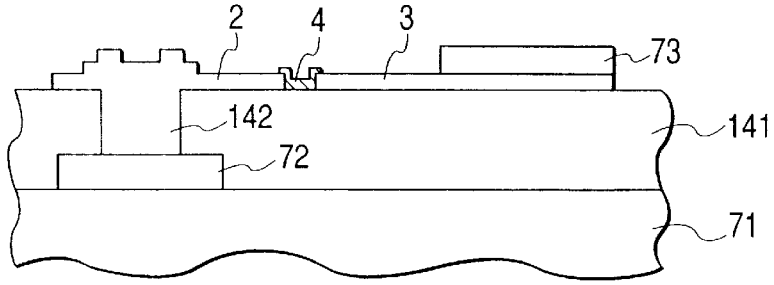

Step-h: A pattern was formed so as to coat the portions except for the portions of contact holes 142 with a resist, and Ti and Au were successively deposited in the thickness of 50 Å and in the thickness of 5000 Å, respectively, by vacuum evaporation. Unnecessary portions were removed by lift-off, thereby stuffing the contact holes 142 (FIG. 17H).

Produced according to the above steps was the electron-source substrate in which the X-directional wires 72, interlayer insulation layer 141, Y-directional wires 73, device electrodes 2, 3, and thin film 4 for formation of electron-emitting sections were formed on the insulative substrate 1.

The above device electrodes, wires, and conductive film were produced so that intervals between the electron-emitting devices were equal intervals, 420 m in the Y-direction and 500 μm in the X-direction.

Using the electron-source substrate thus produced, the image-forming apparatus shown in FIG. 6 was fabricated with the face plate described hereinafter.

In FIG. 6, numeral 71 denotes the above-stated electron-source substrate provided with the electron-emitting devices, 81 the rear plate to which the electron-source substrate 71 is fixed, and 86 the face plate in which the fluorescent film 84, the metal back 85, etc. are formed on the internal surface of the glass substrate 83. The gap between the face plate 86 and the rear plate 81 is 4 mm. Numeral 82 represents the support frame, and the rear plate 81 and face plate 86 are joined to the support frame 82 by applying a frit glass of a low melting point thereto and baking it at 410° C. in the atmosphere for ten minutes. These support frame 82, face plate 86, and rear plate 81 compose the envelope 88.

The fluorescent film 84 was comprised of the fluorescent members in the stripe pattern (see FIG. 7A) for realizing color image. The fluorescent film 84 was made by first forming the black stripes and applying the fluorescent members 92 of the respective colors to the regions between the stripes by the slurry method. The material for the black stripes was a material whose principal component was graphite normally often used.

The metal back 85 was provided on the internal surface side of the fluorescent film 84. The metal back 85 was produced by, after production of the fluorescent film 84, subjecting the internal surface of the fluorescent film 84 to the smoothing operation (normally called filming) and thereafter depositing Al by vacuum evaporation.

The face plate 86 was provided with the transparent electrode (not illustrated) of ITO on the external surface side (or on the glass substrate 83 side) of the fluorescent film 84 in order to enhance the electrically conductive property of the fluorescent film 84.

On the occasion of the aforementioned sealing, adequate position alignment was conducted in order to achieve correspondence between the respective color fluorescent members 72 and the surface conduction electron-emitting devices 74 in the color case.

<Forming/Activation/Stabilization Steps>

Subsequently, the forming and activation steps were carried out and then the stabilization operation was conducted.

These steps of forming, activation, and stabilization were carried out using the vacuum system shown in FIG. 9. In FIG. 9 1131 represents the panel fabricated by the above steps, and 1132 the exhaust pipe, which connects the panel 1131 to the vacuum chamber 1133. The vacuum chamber 1133 is connected to the gate valve 1134 and the gate valve 1134 is connected to the evacuation unit 1135. The evacuation unit 1135 is composed of a magnetic levitation type turbo-molecular pump and a dry pump for backup connected thereto through a valve not illustrated. The vacuum chamber 1133 is equipped with the pressure gage 1136 for monitoring the pressure inside and the quadrupole mass spectrometer (Q-mass) 1137 for monitoring the composition of partial pressures of gases inside the vacuum chamber 1133. Further, the vacuum chamber 1133 is connected through the gas inlet line 1138 and the gas introduction control unit 1139 disposed midway of the gas inlet line 1138 to the ampoule in which the introduced substance source 1140 is encapsulated. In the present example a variable leak valve ready for ultrahigh vacuum was used as the gas introduction control unit and benzonitrile as the introduced substance source.

The gas in the envelope 88 of the panel produced by the foregoing steps was exhausted by the evacuation unit 1135 through the exhaust line 1132 and vacuum chamber 1133. After the indication of the pressure gage 1136 reached about $1\times10^{-3}$ Pa, the voltage was applied to each thin film for formation of electron-emitting section on the aforementioned electron-source substrate 1171 through the terminals Dx1 to Dxm and Dy1 to Dyn outside the envelope 88 shown in FIG. 6, to form the electron-emitting section in the thin film for formation thereof, thus completing the forming operation of the electron-source substrate in the present embodiment.

The pulsed voltage was used for the forming operation. In the present example the pulse width was 1 msec and the pulse separation was 10 msec.

Then the activation operation was carried out using the apparatus of FIG. 9 and the voltage waveform shown in FIG. 12B. The activation operation of the present example was carried out under the following conditions: the pulse width was 1 msec, the pulse separation was 10 msec, the peak value Vf was 15 V, the voltages of the positive and negative polarities with the same amplitude were applied, and the operation was conducted in the benzonitrile ambience under about $1\times10^{-4}$ Pa as an indication of the pressure gage 1136 and with measuring the device current If and emission current Ie. Prior to the activation operation, the inside of the vacuum chamber 1133 was evacuated to the pressure of about $2\times10^{-5}$ Pa or less, and then benzonitrile was introduced into the vacuum chamber 1133 by adjusting the gas introduction control unit 1139. On that occasion, it was checked with the Q-mass 1137 that gas molecules of benzonitrile were surely introduced into the vacuum chamber 1133.

Then the stabilization operation was carried out. The stabilization operation was conducted by evacuating while heating the whole of the envelope 88 at 200° C. for ten hours. After completion of the stabilization operation, the pressure in the vacuum chamber 1133 at room temperature was about $1\times10^{-6}$ Pa.

<Aging Step>

Subsequently, the panel 101 after the above steps was connected to the aging apparatus shown in FIG. 13. Rectangular pulses with the pulse width of 150 $\mu$sec and the pulse peak value Vf=+15 V were applied at the scanning frequency 60 Hz to each electron-emitting device in each line from the electron-source driving unit 123 through the external terminals Dx1 to Dxm, and the high dc voltage of Va=721 V was applied through the high-voltage terminal Hv to the metal back 85 and the transparent electrode (not illustrated). At this time the external terminals Dy1 to Dyn were maintained substantially at the reference potential (0 V) through the driving current measuring unit 124. The potential relation between Dy1 to Dyn and Dx1 to Dxm driven in the present step was reverse to that during the image display finally conducted.

The values of the driving voltage Vf of electron-emitting device and the anode voltage Va in the aging step of the present example were set so as to satisfy (Equation 2). Specifically, they were determined as follows. Using the following values: the device-to-device pitch P in the X-direction being the direction of connection between the device electrodes, $P=5.0\times10^{-4}$ m, the gap H between the face plate 86 and the rear plate 81, $H=4.0\times10^{-3}$ m, the peak value Vfp of the voltage pulses applied between the device electrodes during the normal driving, Vfp=15 V, and the anode voltage Vap during the normal driving, Vap=8000 V; when n=3 and when the voltage applied to the devices during the aging step was Vf=15 V, the anode voltage Va in the aging step was determined by the following.

(Equation 4)

$$3\cdot5.0\times10^{-4}=2\cdot4.0\times10^{-3}\cdot\sqrt{(15/Va)}+2\cdot4.0\times10^{-3}\cdot\sqrt{(15/8000)}$$

By this aging operation under the above aging conditions, the degassing process was able to be performed in the image-forming units for the final image formation (i.e., in the pixel units formed of the fluorescent members), particularly, in the areas most irradiated with the electron beams.

In this way the face plate was bombarded with the electron beams emitted from each electron-emitting device and gas molecules desorbed were removed through the exhaust pipe 1132 to the outside of the display panel 101. This operation was carried on for about one hour, then completing the aging step.

<Encapsulation/Getter Flash Steps>

After that, the exhaust pipe 1132 was heated by a gas burner to be fused, thus achieving encapsulation of the envelope 88. In the last step, the getter operation was carried out by high-frequency heating in order to maintain the pressure in the panel after the encapsulation.

Comparative Example 1

As Comparative Example 1, the image-forming apparatus was produced in the same manner as in Example 1 up to the sealing/getter flash steps except for only the aging step. Thus, the aging step was not carried out at all in the present comparative example.

The image-forming apparatus completed as described above was driven by the driving device of the image-forming apparatus shown in FIG. 8 in such a manner that the scanning signals and modulation signals were supplied from the signal generating means through the external terminals Dx1 to Dxm, Dy1 to Dyn to apply the voltage pulses of 15 V between the device electrodes of each electron-emitting device 74, the high voltage of 8 kV was applied through the high-voltage terminal Hv to the metal back 85 and the transparent electrode (not illustrated) to accelerate the electron beams and bombard the fluorescent film 84 therewith so as to achieve excitation and luminescence thereof and in turn bring about the image display, and the emission current Ie was measured. The display image at this time was white over the entire surface. An average of emission current values Ie of one typical line (100 devices), <Ie>($\mu$A), and a percentage of standard deviation to the average, ΔIe (%), were calculated at each time, immediately after the start and at the end. They were obtained as listed in Table 1 below.

TABLE 1

| | <Ie> ($\mu$A) right after start | ΔIe (%) right after start | <Ie> ($\mu$A) at end | ΔIe (%) at end |
|---|---|---|---|---|
| Example 1 | 403 | 10.2 | 370 | 10.8 |
| Comparative Example 1 | 415 | 12.2 | 257 | 23.5 |

As seen from the table, the image-forming apparatus obtained through the aging step of the present invention formed the display images of higher quality (with less variation) from the beginning of driving over a long term and on a stable basis, as compared with the conventional image-forming apparatus produced without the aging step.

Example 2

The present example is an example in which the aging step according to the present invention is applied after the getter flash and encapsulation steps by use of the image-forming apparatus on the occasion of fabrication of the image-forming apparatus in which a lot of surface conduction electron-emitting devices are arrayed in the simple matrix layout on the electron-source substrate.

The image display panel 101 using a lot of surface conduction electron-emitting devices was fabricated in the same manner as in Example 1. In the present example the materials and dimensions for the display panel 101 were the same as those in Example 1 except that the X-directional intervals between the electron-emitting devices and the intervals of the fluorescent members of the respective colors on the face plate were 360 $\mu$m. However, the encapsulation/getter flash steps were carried out without performing the aging step after the stabilization step in the production steps of the display panel 101.

Then the display panel 101 underwent the aging step by use of the driving device of the image-forming apparatus shown in FIG. 8. On this occasion, all S1 to Sm in the drawing were set to select Vx, the voltage Vx was set to −7.5 V, the voltage upon selection of the scanning signals applied to Dy1 to Dyn was set to +7.5 V, and the voltage of Va was varied at the elevation rate of 5 V/min from +590 V to +890 V. The scanning frequency for driving the electron source during this aging step was 60 Hz and the select time upon selection of one line was 150 $\mu$sec for the all lines. The potential relation of the voltage applied between Dy1 to Dyn and Dx1 to Dxm in the present step was reverse to that during the image display conducted hereinafter.

The values of the driving voltage Vf of electron-emitting devices and the anode voltage Va in the aging step of the present example were set so as to satisfy (Equation 3). Specifically, they were determined as follows. Using the following values: the device-to-device pitch P in the X-direction being the direction of connection between the device electrodes, $P=3.6\times10^{-4}$ m, the gap H between the face plate 86 and the rear plate 81, $H=4.0\times10^{-3}$ m, the peak value Vfp of the voltage pulses applied between the device electrodes during the image display described hereinafter, Vfp=15 V, and the anode voltage Vap=8000 V; when n=4 and when the voltage applied between the device electrodes during the aging step is Vf=15 V, the minimum voltage Vamin and maximum voltage Vamax of Va during the aging can be obtained from the relational equation of (Equation 3) as follows.

(Equation 5-1)

$$Vamin=15/(4\times3.6\times10^{-4}/8.0\times10^{-3}-0.475\sqrt{(15/8000)})^2=590$$

(Equation 5-2)

$$Vamax=15/(4\times3.6\times10^{-4}/8.0\times10^{-3}-1.165\sqrt{(15/8000)})^2=894$$

The anode voltage Va in the aging step was determined based on these values. By this aging operation under the above aging conditions, the degassing process was effected in the image-forming units during the final image formation (i.e., in the pixel units formed of the fluorescent members), particularly, in the almost all areas irradiated with the electron beams.

In this way the face plate was bombarded with the electron beams emitted from each electron-emitting device and the gas molecules desorbed were evacuated by the getter pump formed inside the display panel 101. This operation was carried on for about one hour, then completing the aging step.

Comparative Example 2

As Comparative Example 2, the image-forming apparatus was produced in the same manner as in Example 2 up to the encapsulation/getter flash steps. Thus the aging step was not carried out at all in the present comparative example.

The image-forming apparatus completed as described above was driven by the driving device of the image-forming apparatus shown in FIG. 8 in such a manner that the scanning signals were −7.5 V, the peak value Vx of the modulation signals was +7.5 V, the voltage pulses of 15 V were thus applied between the device electrodes of each electron-emitting device 74 from the signal generating means through the external terminals Dx1 to Dxm, Dy1 to Dyn, the high voltage of +8 kV was applied through the high-voltage terminal Hv to the metal back 85 and the transparent electrode (not illustrated) to accelerate the electron beams and bombard the fluorescent film 84 therewith so as to achieve excitation and luminescence thereof and in turn bring about the image display, and the emission current Ie was measured. The display image at this time was white over the entire surface. An average of emission current values Ie of one typical line (100 devices), <Ie>(μA), and a percentage of standard deviation to the average, ΔIe (%), were calculated at each time, immediately after the start and at the end. They were obtained as listed in Table 2 below.

TABLE 2

| | <Ie> (μA) right after start | ΔIe (%) right after start | <Ie> (μA) at end | ΔIe (%) at end |
|---|---|---|---|---|
| Example 2 | 424 | 10.5 | 381 | 10.7 |
| Comparative Example 2 | 430 | 11.0 | 254 | 23.1 |

As seen from the table, the image-forming apparatus obtained through the aging step of the present invention formed the display images of higher quality (with less variation) from the beginning of driving over a long term and on a stable basis, as compared with the conventional image-forming apparatus produced without the aging step.

Example 3

The imaging-forming apparatus produced in the present example is the same in the structure of the image-forming apparatus and in the all process conditions of the respective steps as in Example 2 except that the production steps of the image-forming apparatus after evacuation are carried out in the order of the forming operation, activation operation, stabilization operation, getter operation, aging operation, and encapsulation.

The image-forming apparatus of the present example was produced as described above and was driven in the same manner as in Example 2, and the emission current Ie thereof was measured and compared with that in Comparative Example 2. The results are as shown in Table 3 below.

TABLE 3

| | <Ie> (μA) right after driving | ΔIe (%) right after driving | <Ie> (μA) at end | ΔIe (%) at end |
|---|---|---|---|---|
| Example 3 | 426 | 9.6 | 397 | 9.8 |
| Comparative Example 2 | 430 | 11.0 | 254 | 23.1 |

As seen from the table, the image-forming apparatus obtained through the aging step of the present invention formed the display images of higher quality (with less variation) from the beginning of driving over a long term and on a stable basis, as compared with the image-forming apparatus of the comparative example.

Example 4

The imaging-forming apparatus produced in the present example is produced substantially in the same structure and by the same process as in Example 2 except that the intervals between the electron-emitting devices and the intervals of the color fluorescent members on the face plate in the X-direction are $4.6\times10^{-4}$ m, three more columns of the electron-emitting devices are produced in the X-direction on the electron-source substrate, and the additional three columns of electron-emitting devices are driven only during the aging.

The structure of the image-forming apparatus of the present example will be described in further detail.

In the present example the simple matrix structure of the electron-source substrate 71 shown in FIG. 6 includes 100 rows of X-directional wires and 103 columns of Y-directional wires. Thus, three more columns are added in the X-direction and three more columns of electron-emitting devices are also added corresponding thereto. On the other hand, the columns of pixels of the fluorescent members formed on the face plate are totally 100 columns of the colors R, G, B. Alignment between the rear plate and the face plate is so set that the electron beams emitted from the electron-emitting devices connected to the Y-directional wires Dy1 to Dy100 respectively irradiate the fluorescent members of the respective colors in the 100 columns during the normal driving.

The position alignment was carried out as described above, the envelope was then constructed and sealed, then the forming operation, activation operation, and stabilization operation were carried out in the same manner as in Example 1, thereafter the getter activation step was conducted, and then the encapsulation step was executed. The image-forming apparatus under the production steps, obtained by the above steps, was connected to the apparatus shown in FIG. 8 in the same manner as in Example 2, and underwent the aging operation.

In the present example S1 to S3 in FIG. 8 are set to select the ground potential and S4 to S103 to select Vx during the aging step. Under the above setting, Vx was set to −7.5 V, the voltage upon selection of the scanning signals applied to Dy1 to Dyn was set to +7.5 V, and the voltage of Va was varied at the elevation rate of about 6 V/min from+650 V to +1007 V. The scanning frequency for driving the electron source during the aging step was 60 Hz and the select time upon selection of one line was 150 μsec for the all lines.

The values of the driving voltage Vf of electron-emitting devices and the anode voltage Va in the aging step of the present example were set so as to satisfy (Equation 3). Specifically, they were determined as follows. Using the following values: the device-to-device pitch P in the X-direction being the direction of connection between the device electrodes, $P=4.6\times10^{-4}$ m, the gap H between the face plate 86 and the rear plate 81, $H=4.0\times10^{-3}$ m, the peak value Vfp of the voltage pulses applied between the device electrodes during the image display described hereinafter, Vfp=15 V, and the anode voltage Vap=8000 V; when n=3 and when the voltage applied between the device electrodes during the aging step is Vf=15 V, the minimum voltage Vamin and maximum voltage Vamax of Va during the aging can be obtained from the relational equation of (Equation 3) as follows.

$$Va\min = 15 \div \left(\frac{3\times4.6\times10^{-4}}{2\times4.0\times10^{-3}} - 0.475\times\sqrt{\frac{15}{8000}}\right)^2 = 650 \quad \text{(Equation 6-1)}$$

$$Va\max = 15 \div \left(\frac{3\times4.6\times10^{-4}}{2\times4.0\times10^{-3}} - 1.165\times\sqrt{\frac{15}{8000}}\right)^2 = 1007 \quad \text{(Equation 6-2)}$$

The range of the anode voltage Va in the aging step was determined based on these values.

Let symbol E(M,N) represent the electron-emitting device connected at the intersecting point between the X-directional wire in the M-th row and the Y-directional wire in the N-th column. Then electron beams emitted from E(M,N+3) during the aging irradiate irradiation positions of the electron beams emitted from E(M,N) during the normal driving. Here, $1\leqq M\leqq100$ and $1\leqq N\leqq100$.

By this aging operation under the above aging conditions of the present example as described above, the degassing process was effected in the image-forming units during the final image formation (i.e., in the pixel units formed of the fluorescent members), particularly, in the all areas irradiated with the electron beams. This aging method is not limited to the case of n=3, but it can be properly set corresponding to n in (Equation 3), as in the present example.

In this way the face plate was bombarded with the electron beams emitted from each electron-emitting device and the gas molecules desorbed were evacuated by the getter pump formed inside the display panel 101. This operation was carried on for about one hour, then completing the aging step.

The image-forming apparatus of the present example was produced as described above and was driven in the same manner as in Example 2, and the emission current Ie thereof was measured and compared with that in Comparative Example 2. The results are as shown in Table 4 below.

TABLE 4

| | <Ie> (μA) right after driving | ΔIe (%) right after driving | <Ie> (μA) at end | ΔIe (%) at end |
|---|---|---|---|---|
| Example 4 | 428 | 9.5 | 395 | 9.8 |
| Comparative Example 2 | 430 | 11.0 | 254 | 23.1 |

As seen from the table, the image-forming apparatus obtained through the aging step of the present invention formed the display images of higher quality (with less variation) from the beginning of driving over a long term and on a stable basis, as compared with the image-forming apparatus of the comparative example.

Example 5

The present example is an example using the transverse field emission type electron-emitting devices as the electron-emitting devices constituting the electron source. The fundamental structure of the electron-source substrate is substantially the same as shown in Example 1, but the section of each electron-emitting device has the structure schematically shown in FIG. 3.

In FIG. 3 there are the electrode 162 for emitter, the gate electrode 163, the emitter 164, and the emitter 165 for aging formed through an insulating layer of silicon oxide film 0.5 μm thick on an electrically insulative substrate 161 made of soda lime glass. The emitter electrode 162, gate electrode 163, emitter 164, and aging emitter 165 are made of a thin film of Pt in the thickness of 0.3 μm. Tips of the emitter 164 serve as the electron-emitting sections during the normal driving, while tips of the aging emitter 165 serve as the electron-emitting sections during the aging. The angles of the tips are 30°.

The method for producing the electron-source substrate is carried out according to the substantially same procedures as in Example 1. In the present example, however, the emitter electrodes and gate electrodes of the transverse field emission type electron-emitting devices are fabricated instead of the formation of the device electrodes of the surface conduction electron-emitting devices conducted in the step-d in Example 1. Further, the present example excludes the formation and patterning of the conductive film for formation of the electron-emitting sections of the surface conduction electron-emitting devices, which were performed in the steps-f, g in Example 1.

The emitter electrodes and gate electrodes were made of Pt film in the thickness of 0.3 μm by sputtering. Subsequently, the photoresist was applied and baked to form a resist layer. Thereafter, it was exposed and developed with a photomask to form a resist pattern corresponding to the shape of the emitter electrodes 162, the gate electrodes 163, the emitters 164, and the aging emitters 165. After this, dry etching was effected to form the emitter electrodes 162, gate electrodes 163, emitters 164, and aging emitters 165 in the desired shape, and the resist was removed thereafter. This resulted in forming the emitter electrodes 162, gate electrodes 163, emitters 164, and aging emitters 165 in the shape shown in FIG. 3 at predetermined positions on the insulative substrate 161.

Using this electron-source substrate, the image-forming apparatus was constructed with the getter structure on the electron source in the substantially same procedures as in Example 1. However, the forming operation, and the activation operation of the electron-emitting devices are not required, different from the case using the surface conduction electron-emitting devices.

Specifically, the stabilization operation was carried out by connecting the envelope through the exhaust pipe to the vacuum unit, evacuating the vacuum chamber 1133 to the pressure of $1\times10^{-5}$ Pa inside, and thereafter evacuating while heating the whole of the envelope 88 at 200° C. for ten hours. After completion of the stabilization operation, the pressure inside the vacuum chamber 1133 at room temperature was about $1\times10^{-6}$ Pa.

Then the getter agent placed inside the envelope was heated by high-frequency heating to bring about the getter activation operation for evaporating a thin film containing a principal component of Ba on the components inside the envelope. After that, the exhaust pipe 1132 was heated by the gas burner to be fused, thereby achieving encapsulation of the envelope 8.

In the end the aging step was carried out. The display panel 101 was connected to the aging apparatus shown in FIG. 13. Rectangular pulses with the pulse width of 150 μsec and the pulse peak value Vf=+100 V were applied at the scanning frequency 60 Hz to each electron-emitting device in each line from the electron-source driving unit 123 through the external terminals Dyo1 to Dyon, and the high dc voltage of Va=1000 V was applied through the high-voltage terminal Hv to the metal back 85 and the transparent electrode (not illustrated). At this time the external terminals Dy1 to Dxm were maintained substantially at the reference potential (0 V) through the driving current measuring unit 124. The potential relation between Dy1 to Dyn and Dx1 to Dxm driven in the present step is reverse to that during the image display finally conducted.

In this way the electron beams emitted from each electron-emitting device were made to collide with the face plate and the gas molecules desorbed were exhausted by the getter pump formed in the envelope. This operation was carried on for about one hour and then the aging step was ended.

Comparative Example 3

As Comparative Example 3, the image-forming apparatus was produced in the same manner as in Example 5 except that the peak value of the pulse voltage applied through the external terminals Dy1 to Dyn to the Y-directional wires during the aging step was set to Vf=−100V. Therefore, this comparative example does not include the aging step by the opposite polarity driving, but the driving is also conducted in the same polarity during the aging step as during the normal driving.

The image-forming apparatus completed as described above was driven by the driving device of the image-forming apparatus shown in FIG. 8 in such a manner that with the scanning signals and the modulation signals the voltage pulses of 100 V were applied between the device electrodes of each electron-emitting device 74 from the signal generating means through the external terminals Dx1 to Dxm, Dy1 to Dyn, the high voltage of 8 kV was applied through the high-voltage terminal Hv to the metal back 85 and the transparent electrode (not illustrated) to accelerate the electron beams and bombard the fluorescent film 84 therewith so as to achieve excitation and luminescence thereof and in turn bring about the image display, and the emission current Ie was measured at the same time. The display image at this time was white over the entire surface.

The image-forming apparatus obtained through the aging step of the present invention formed the display images of higher quality (with less variation) from the beginning of driving over a long term and on a stable basis, as compared with the image-forming apparatus of the comparative example.

The present invention can provide the image-forming apparatus with high reliability which is considerably reduced in degradation of the electron-emitting devices during the image formation, particularly, in degradation of the electron-emitting devices due to the desorption of gas from the image-forming member during the image formation.

In addition, the present invention can provide the image-forming apparatus with high reliability in which influence of the degradation of the electron-emitting devices in the production process of the image-forming apparatus is reduced to the least during the image formation.

What is claimed is:

1. A method for producing an image-forming apparatus, said image-forming apparatus comprising a container, an electron-emitting device disposed in said container and having an electron-emitting section between a pair of electrodes, said electron-emitting device being adapted to emit electrons with application of a voltage between said pair of electrodes, and an image-forming member for forming an image by irradiation of the electrons emitted from said electron-emitting device, said production method having a step of irradiating said image-forming member with electrons emitted from the electron-emitting device, wherein said electrons to irradiate said image-forming member are electrons emitted by applying to the electron-emitting device a voltage of an opposite polarity to that of the voltage applied between the pair of electrodes of the electron-emitting device during driving for image formation of said image-forming apparatus.

2. A method for producing an image-forming apparatus, said image-forming apparatus comprising a container, an electron-emitting device disposed in said container and having a plurality of electron-emitting sites between a pair of electrodes, said electron-emitting device being adapted to emit electrons from some of said plurality of electron-emitting sites with application of a voltage between said pair of electrodes, and an image-forming member for forming an image by irradiation of the electrons emitted from said electron-emitting device, said production method having a step of irradiating the image-forming member with electrons emitted from said electron-emitting device, wherein said electrons to irradiate the image-forming member are electrons emitted from different electron-emitting sites from those during driving for image formation of said image-forming apparatus.

3. The production method of image-forming apparatus according to claim 1 or 2, wherein said step of irradiating said image-forming member with the electrons emitted from the electron-emitting device is carried out with evacuating the inside of said container.

4. The production method of image-forming apparatus according to claim 1 or 2, wherein an encapsulation operation of said container is carried out after said step of irradiating said image-forming member with the electrons emitted from the electron-emitting device.

5. The production method of image-forming apparatus according to claim 1 or 2, wherein a getter flash operation is carried out in said container after said step of irradiating said image-forming member with the electrons emitted from the electron-emitting device.

6. The production method of image-forming apparatus according to claim 1 or 2, wherein said step of irradiating said image-forming member with the electrons emitted from the electron-emitting device is carried out with evacuating the inside of said container and after said step, an encapsulation operation of said container and a getter flash operation in said container are carried out.

7. The production method of image-forming apparatus according to claim 1 or 2, wherein said step of irradiating said image-forming member with the electrons emitted from the electron-emitting device is carried out after completion of an encapsulation operation of said container.

8. The production method of image-forming apparatus according to claim 1 or 2, wherein said step of irradiating said image-forming member with the electrons emitted from the electron-emitting device is carried out after completion of a getter flash operation in said container.

9. The production method of image-forming apparatus according to claim 1 or 2, wherein said step of irradiating said image-forming member with the electrons emitted from the electron-emitting device is carried out after completion of an encapsulation operation of said container and a getter flash operation in said container.

10. The production method of image-forming apparatus according to claim 1 or 2, wherein said image-forming apparatus has a plurality of said electron-emitting devices and wherein said step of irradiating said image-forming member with the electrons emitted from the plurality of electron-emitting devices is carried out under such a condition that, provided that P is an array pitch of said plurality of electron-emitting devices in a direction of connection between said pair of electrodes, −Vf is a potential of other electrode with respect to one electrode out of said pair of electrodes, Va is a voltage applied to the image-forming member, Vfp is a potential of said other electrode with respect to said one electrode out of said pair of electrodes during the driving for image formation of said image-forming apparatus, Vap is a voltage applied to the image-forming member during the driving for image formation of said image-forming apparatus, and H is a distance between the electron-emitting devices and said image-forming member, said Va and said Vp are set so as to satisfy the following:

$$n \cdot P = 2H\sqrt{(Vf/Va)} + 2H\sqrt{(Vfp/Vap)},$$

where n is a positive integer.

11. The production method of image-forming apparatus according to claim 1 or 2, wherein said image-forming apparatus has a plurality of said electron-emitting devices and wherein said step of irradiating said image-forming member with the electrons emitted from the plurality of electron-emitting devices is carried out under such a condition that, provided that P is an array pitch of said plurality of electron-emitting devices in a direction of connection between said pair of electrodes, −Vf is a potential of other electrode with respect to one electrode out of said pair of electrodes, Va is a voltage applied to the image-forming member, Vfp is a potential of said other electrode with respect to said one electrode out of said pair of electrodes during the driving for image formation of said image-forming apparatus, Vap is a voltage applied to the image-forming member during the driving for image formation of said image-forming apparatus, and H is a distance between the electron-emitting devices and said image-forming member, said Va and said Vp are set so as to satisfy the following:

$$n \cdot P/(2H) - 1.165\sqrt{(Vfp/Vap)} \leqq \sqrt{(Vf/Va)} \leqq n \cdot P/(2H) - 0.475\sqrt{(Vfp/Vap)},$$

where n is a positive integer.

12. The production method of image-forming apparatus according to claim 1 or 2, wherein said electron-emitting device is a surface conduction electron-emitting device.

13. The production method of image-forming apparatus according to claim 1 or 2, wherein said electron-emitting device is a field emission type electron-emitting device.

14. A method for producing an image-forming apparatus, said image-forming apparatus comprising a container, an electron-emitting device disposed in said container and having an electron-emitting section between a pair of electrodes, said electron-emitting device being adapted to emit electrons with application of a voltage between said pair of electrodes, and an image-forming member for forming an image by irradiation of the electrons emitted from said electron-emitting device, said production method having a step of irradiating said image-forming member with electrons emitted from the electron-emitting device, wherein said electrons to irradiate said image-forming member are electrons emitted by applying to the electron-emitting device a voltage of an opposite polarity to that of the voltage applied between the pair of electrodes of the electron-emitting device during driving for image formation of said image-forming apparatus, and said electrons to irradiate said image-forming member are not electrons emitted by applying to the electron-emitting device a voltage of a polarity of the voltage applied between the pair of electrodes of the electron-emitting device during driving for image formation of said image-forming apparatus.

15. A method for producing an image-forming apparatus, said image-forming apparatus comprising a container, an electron-emitting device disposed in said container and having a plurality of electron-emitting sites between a pair of electrodes, said electron-emitting device being adapted to emit electrons from some of said plurality of electron-emitting sites with application of a voltage between said pair of electrodes, and an image-forming member for forming an image by irradiation of the electrons emitted from said electron-emitting device, said production method having a step of irradiating the image-forming member with electrons emitted from said electron-emitting device, wherein said electrons to irradiate the image-forming member are electrons emitted from different electron-emitting sites from those during driving for image formation of said image-forming apparatus, and said electrons to irradiate the image-forming member are not electrons emitted from electron-emitting sites during driving for image-formation of said image-forming apparatus.

* * * * *

UNITED STATES PATENT AND TRADEMARK OFFICE

CERTIFICATE OF CORRECTION

PATENT NO. : 6,259,422 B1
DATED : July 10, 2001
INVENTOR(S) : Yasuhiro Hamamoto

It is certified that error appears in the above-identified patent and that said Letters Patent is hereby corrected as shown below:

Title page,
Item [56], References Cited, under U.S. PATENT DOCUMENTS,
"7/1996" should read -- 6/1996 --; and Item [57], ABSTRACT,
Line 2, "comprises" should read -- comprising --; and
Line 3, "has" should read -- having --.

Column 2,
Line 8, "member etc." should read -- member, etc., --;
Line 23, "drop" should read -- drops --; and
Line 28, "follows;" should read -- follows: --.

Column 5,
Line 64, "current le" should read -- current Ie --; and
Line 67, "current le" should read -- current Ie --.

Column 6,
Line 3, "current le." should read -- current Ie. --;
Line 22, "current le" should read -- current Ie --;
Line 58, "electrodes" should read -- set of electrodes --; and
Line 60, "electrodes" should read -- set of electrodes --.

Column 7,
Line 37, "etc." should read -- etc., --.

Column 10,
Line 42, "current le." should read -- current Ie. --.

Column 11,
Line 20, "longer" should read -- long a --.

UNITED STATES PATENT AND TRADEMARK OFFICE

CERTIFICATE OF CORRECTION

PATENT NO. : 6,259,422 B1
DATED : July 10, 2001
INVENTOR(S) : Yasuhiro Hamamoto

It is certified that error appears in the above-identified patent and that said Letters Patent is hereby corrected as shown below:

Column 12,
Line 3, "etc." should read -- etc., --.

Column 14,
Line 9, "normal" should read -- normal driving --;
Line 11, "ten and several" should read -- several tens of --; and
Line 19, "members etc." should read -- members, etc., --.

Column 15,
Line 12, "substrate" should read -- substrate, --.

Column 16,
Line 13, "B2 (1970)" should read -- V2 (1970), --; and
Line 36, "devices)." should read -- device). --.

Column 18,
Line 60, "system," should read -- systems, --.

Column 20,
Line 32, "Step-g:" should read -- ¶Step-g: --;
Line 34, "baked," should read -- baking --;
Line 48, "420 m" should read -- 420 $\mu$m --; and
Line 57, "etc." should read -- etc., --.

Column 21,
Line 52, "substrate 1171" should read -- substrate 71 --.

Column 26,
Line 32, "the all" should read -- all the --.

UNITED STATES PATENT AND TRADEMARK OFFICE

CERTIFICATE OF CORRECTION

PATENT NO. : 6,259,422 B1
DATED : July 10, 2001
INVENTOR(S) : Yasuhiro Hamamoto

It is certified that error appears in the above-identified patent and that said Letters Patent is hereby corrected as shown below:

Column 28,
Line 45, "Dyo1 to Dyon," should read -- Dy1 to Dyn, --; and
Line 49, "Dy1" should read -- Dx1 --.

Signed and Sealed this

Twelfth Day of March, 2002

*Attest:*

*Attesting Officer*

JAMES E. ROGAN
*Director of the United States Patent and Trademark Office*